US006964464B2

(12) United States Patent
Usuda

(10) Patent No.: US 6,964,464 B2
(45) Date of Patent: Nov. 15, 2005

(54) DRIVING DEVICE FOR LIQUID DROP EJECTING HEAD, DEVICE FOR FORMING MEMBRANE, METHOD FOR DRIVING LIQUID DROP EJECTING HEAD, METHOD FOR FORMING MEMBRANE, ELECTRONIC APPARATUS, AND METHOD FOR MANUFACTURING DEVICE

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 119 days.

(21) Appl. No.: 10/623,662

(22) Filed: Jul. 22, 2003

(65) Prior Publication Data

US 2005/0078132 A1 Apr. 14, 2005

(30) Foreign Application Priority Data

Jul. 31, 2002 (JP) ..... 2002-223152
Mar. 17, 2003 (JP) ..... 2003-072335

(51) Int. Cl.[7] ..... B41J 2/045
(52) U.S. Cl. ..... 347/10; 347/68
(58) Field of Search ..... 347/10–11, 68, 347/57

(56) References Cited

U.S. PATENT DOCUMENTS 5,541,628 A * 7/1996 Chang et al. ..... 347/10
5,593,757 A * 1/1997 Kashiwazaki et al. ... 428/195.1
6,331,040 B1 * 12/2001 Yonekubo et al. ..... 347/15

FOREIGN PATENT DOCUMENTS

| | | |
|---|---|---|
| JP | A 10-226066 | 8/1998 |
| JP | A 10-329313 | 12/1998 |
| JP | A 11-20165 | 1/1999 |
| JP | A 2000-193922 | 7/2000 |
| JP | A 2001-80072 | 3/2001 |
| JP | A 2002-55222 | 2/2002 |
| JP | A 2002-59614 | 2/2002 |

OTHER PUBLICATIONS

Kobayashi et al., "A novel RGB multicolor light-emitting polymer display", 2000, Elsevier Science.*

* cited by examiner

*Primary Examiner*—Thinh Nguyen
(74) *Attorney, Agent, or Firm*—Oliff & Berridge, PLC

(57) ABSTRACT

A memory for storing an information which relates to a plurality of different line-segmented-waveforms which correspond to address, a control IC which reads out the information which relates to the inclination of the line-segmented-waveforms from a corresponding memory according to a predetermined readout timing when the address is designated and forms the line-segmented-waveform according to the information which relates to the inclination and generates a driving waveform by combining the line-segmented waveforms, and a driving section which drives the piezoelectric transducer according to the driving waveform so as to eject a liquid drop from an ejecting section are provided. The line-segmented-waveform is formed by waveforms of which a variation amount of voltage becomes smaller nearer an end section of the driving waveform.

19 Claims, 14 Drawing Sheets

DRIVING DEVICE FOR LIQUID DROP EJECTING HEAD, DEVICE FOR FORMING MEMBRANE, METHOD FOR DRIVING LIQUID DROP EJECTING HEAD, METHOD FOR FORMING MEMBRANE, ELECTRONIC APPARATUS, AND METHOD FOR MANUFACTURING DEVICE

BACKGROUND OF THE INVENTION

1. Field of the Invention

Present invention relates to a method for driving a liquid drop ejecting head for ejecting a liquid drop from an ejecting section by driving a piezoelectric transducer by a predetermined driving waveform. In particular, the present invention relates to a device for driving a liquid drop ejecting head for generating a driving waveform by combining line-segmented-waveforms which are contained in a memory, a device for forming a membrane, a method for driving a liquid drop ejecting head, a method for forming a membrane, and a method for manufacturing an electronic apparatus and a device.

2. Description of Related Art

A liquid drop ejecting head which vibrates a transducer for ejecting a liquid drop by expanding and contracting the piezoelectric transducer is used in a liquid drop ejecting device which is called an ink jet printer which is used for a manufacturing device for a liquid crystal display panel and a printing device of a computer terminal. The piezoelectric transducer is formed by, for example, a piezo (PZT)-element. The piezo-element expands and contracts a driving waveform which is inputted thereto (for example, a voltage waveform).

In a device for driving a liquid drop ejecting head having such a structure, the piezoelectric transducer is driven by an approximate trapezoid square voltage waveform shown in FIG. 16. For example, an electric potential Vcom in the drawing is a predetermined voltage which is charged to the piezoelectric transducer. An electric potential VH indicates a voltage value for most contracting the piezoelectric transducer in a liquid drop ejecting direction. Also, an electric potential VL indicates a voltage value for most expanding the piezoelectric transducer in a liquid drop ejecting direction. A layered piezo-element contracts most in a liquid drop ejecting direction when a charged voltage is at an electric potential VL. The layered piezo-element is released from the contraction and expands when a charged voltage is at an electric potential VL. That is, the piezo-element is displaced in a liquid drop ejecting direction by an inertia over a displacement value 0 which indicates a static condition. A liquid drop ejecting device ejects a liquid drop by a piezoelectric transducer which expands and contracts.

Also, a driving waveform shown in FIG. 16 is generated by, for example, a D/A converter. Here, a driving waveform ascends stepwise at it output end by a constant voltage $\Delta V$ per a unit time $\Delta T$ as shown in a magnified manner in FIG. 17. Such a conventional liquid drop ejecting device for ejecting a liquid drop by driving a piezoelectric transducer by using a driving waveform is disclosed in a patent document 1, for example, Japanese Unexamined Patent Application, First Publication No. 2002-059614.

By the way, the piezoelectric transducer repeats physical operations such as expansion and contraction; therefore, an element itself becomes worn and deteriorated. Also, it is known that the element becomes deteriorated sooner and its fatigue life becomes shorter due to factors such as an increase in a thermal load because of a rapid expansion and contraction and an increase in a physical load because of a rapid transition between an expansion/contraction condition and a static condition.

In addition, in a device for driving a liquid drop ejecting head in a conventional technology, the piezoelectric transducer is driven by a trapezoid wave as shown in FIG. 16; therefore, operational status of the piezoelectric transducer alters rapidly in points A0 to A5 in the waveform. Therefore, as explained above, more load is applied to the piezoelectric transducer physical and thermally; thus, there has been a problem in that the element becomes deteriorated sooner and it is not possible to eject a liquid drop from the liquid drop ejecting head stably in a longer time.

SUMMARY OF THE INVENTION

The present invention is made in consideration of the above problem. An object of the present invention is to provide a device for driving a liquid drop ejecting head which can eject a liquid drop stably for a longer time while restricting the deterioration of the piezoelectric transducer, a device for forming a membrane, a method for driving a liquid drop ejecting head, a method for forming a membrane, an electronic apparatus, and a method for manufacturing a device.

In order to solve the above problem, according to the present invention, it is characterized that a device which is provided with a piezoelectric transducer for driving a liquid drop ejecting head for ejecting a functional liquid by using the piezoelectric transducer comprises a memory which corresponds to each address space, a controlling section for memorizing an information which relates to an inclination value of a plurality of different line-segmented-waveforms in the memory, reading out the information which relates to the inclination value of line-segmented-waveform from the corresponding memory according to a predetermined read-out timing, forming the line-segmented-waveform according to the information which relates to the inclination value, and generating a driving waveform by combining the line-segmented-waveforms, a driving section for driving the piezoelectric transducer by the driving waveform and ejecting a liquid drop from an ejecting section on the liquid drop ejecting head. Also, it is characterized in that the information which relates to the inclination value contains information for a variation amount of voltage of the line-segmented-waveform per a unit interval, a plurality of different information for the variation amount of voltage correspond the line-segmented-waveform, and a plurality of the different information for the variation amount of voltage are stored in each memory.

According to the present invention, a plurality of different variation amount of voltage make an information which relates to the inclination of the line-segmented-waveform correspond to a line-segmented-waveform as a variation amount of voltage in the line-segmented-waveform per a unit interval when a controlling section for generating a driving waveform which is applied to the piezoelectric transducer forms a line-segmented-waveform which becomes an element for the driving waveform. Therefore, it is possible to form a line-segmented-waveform by using a plurality of variation amount of voltage; thus, the driving waveform can be formed as a curved waveform. By doing this, a driving waveform having a curved shape is applied to the piezoelectric transducer; therefore, the expansion and the contraction in the piezoelectric transducer becomes more gentle; thus, it is possible to restrict an increase of load physically and thermally.

In order to solve the above problem, according to the present invention, it is characterized that a device which is provided with a piezoelectric transducer for driving a liquid drop ejecting head for ejecting a functional liquid by using the piezoelectric transducer comprises an output section which outputs information which relates to a plurality of different inclination values of the line-segmented-waveform, a controlling section for forming line-segmented-waveform according to the information which relates to the inclination value which is outputted from the output section and generating a driving waveform by combining the line-segmented-waveforms, a driving section for driving the piezoelectric transducer by the driving waveform and ejecting a liquid drop from an ejecting section on the liquid drop ejecting head. Also, it is characterized in that the output section outputs information which relates to the inclination value which contains information for the variation amount of voltage of the line-segmented-waveform per a unit interval such that a plurality of different information for the variation amount of voltage correspond to the line-segmented-waveform.

According to the present invention, a line-segmented-waveform is formed according to information which relates to an inclination of the line-segmented-waveform which is outputted from the output section; thus, there is not a limit for the inclination of the line-segmented-waveform; therefore, it is possible to generate the line-segmented-waveform more desirably. In addition, the information which relates to the inclination of the line-segmented-waveform correspond to a plurality of different variation amount of voltage per a line-segmented-waveform as a variation amount of voltage in the line-segmented-waveform per a unit interval; therefore, it is possible to form a driving waveform in a curved waveform.

Also, in the present invention for a device for driving a liquid drop ejecting head, it is preferable that the line-segmented-waveform is formed by waveforms of which variation amount of voltage becomes smaller nearer an end section of the driving waveform.

According to the present invention, line-segmented-waveform is formed by waveforms of which variation amount of voltage becomes smaller nearer an end section of the driving waveform; therefore, there is not a sharp edge (a point in which a curve reverses rapidly). By doing this, operational status in the piezoelectric transducer changes gently; therefore, it is possible to restrict an increase in a load physically and thermally.

Also, in the present invention for a device for driving a liquid drop ejecting head, it is characterized in that the driving waveform contains an ejection waveform for ejecting the liquid drop and a micro-vibration waveform for causing a micro-vibration on the piezoelectric transducer such that the liquid drop is not ejected.

According to the present invention, it is possible to form not only an ejection waveform by which a liquid drop is ejected but also a micro-vibration waveform for causing a micro-vibration on the piezoelectric transducer for preventing an unstable ejection of a functional liquid due to desiccation and a clogging in a nozzle hole in a curved waveform. By doing this, it is possible to alleviate physical load and a thermal load which is caused by the physical load; thus, it is possible to restrict a deterioration in the piezoelectric transducer and a fatigue life of the piezoelectric transducer can be longer.

Also, in order to achieve the above objects, in the present invention, it is characterized in that a device for forming a membrane comprises a driving device for the liquid drop ejecting head for forming a membrane on an object by ejecting a functional liquid from the liquid drop ejecting head.

According to the present invention, a device for forming a membrane is provided with a liquid drop ejecting head in which a piezoelectric transducer having low physical and thermal load is disposed; therefore, it is possible to provide a device for forming a membrane which can eject a liquid drop stably for a longer time.

Also, in the above invention, it is preferable that the device for forming a membrane is a device for manufacturing a color filter.

According to the present invention, a device for forming a membrane which can eject a liquid drop stably for a longer time serves as a device for manufacturing a color filter; therefore, it is possible to produce a high quality color filter having a membrane of which thickness, flatness, disposition are controlled more precisely and more cheaply than a conventional case.

Also, in the above invention, it is preferable that the above device for forming a membrane serves as a device for manufacturing a membrane which becomes a part of an organic electro-luminescent element.

According to the present invention, a device for forming a membrane which can eject a liquid drop stably for a longer time can serve as a device for manufacturing an organic electro-luminescent element (EL); therefore, it is possible to manufacture a high quality organic EL element (device) cheaply which is formed by a membrane of which thickness, flatness, and disposition are controlled more precisely than in a conventional case.

Also, in order to achieve the above object, it is characterized in that a method according to the present invention for driving a liquid drop ejecting head for ejecting a functional liquid comprises steps of storing information which relates to an inclination value of a plurality of different line-segmented-waveforms in a memory which corresponds to each address space, reading out the information of the inclination value of the line-segmented-waveform from the corresponding memory according to a predetermined read-out timing when the address space is designated, forming a line-segmented-waveform according to the information which relates to the inclination value, generating a driving waveform by combining the line-segmented-waveforms, and driving the piezoelectric transducer by the driving waveform and eject the liquid drop from a ejecting section. It is also characterized in that the information which relates to the inclination value contains information for a variation amount of voltage of the line-segmented-waveform per a unit interval, a plurality of different information for the variation amount of voltage correspond the line-segmented-waveform, and a plurality of the different information for the variation amount of voltage are stored in each memory.

According to the present invention, a plurality of different variation amount of voltage make an information which relates to the inclination of the line-segmented-waveform correspond to a line-segmented-waveform as a variation amount of voltage in the line-segmented-waveform per a unit interval when a line-segmented-waveform which becomes an element for a driving waveform which is applied to the piezoelectric transducer in the liquid drop ejecting head is formed according to a method for driving the liquid drop ejecting head. Therefore, it is possible to form a line-segmented-waveform by using a plurality of variation amount of voltage; thus, the driving waveform can be formed as a curved waveform. By doing this, a driving waveform having a curved shape is applied to the piezoelectric transducer; therefore, the expansion and the contraction in the piezoelectric transducer becomes more gentle; thus, it is possible to restrict an increase of load physically and thermally.

Also, in order to achieve the above object, a method according to the present invention for driving a liquid drop ejecting head for ejecting a functional liquid is characterized in comprising steps of putting out an information of a plurality of different inclination values of line-segmented-waveform, forming the line-segmented-waveform according to the information of the inclination values which are outputted from the output section, generating a driving waveform by combining the line-segmented-waveforms, driving the piezoelectric transducer by the driving waveform, and ejecting a liquid drop from the ejecting section on the liquid drop ejecting head. It is also characterized in that the information which relates to the inclination value contains information for a variation amount of voltage of the line-segmented-waveform per a unit interval, a plurality of different information for the variation amount of voltage correspond the line-segmented-waveform.

According to the present invention, a line-segmented-waveform is formed according to information which relates to an inclination of the line-segmented-waveform which is outputted from the output section; thus, there is not a limit for the inclination of the line-segmented-waveform; therefore, it is possible to generate the line-segmented-waveform more desirably. In addition, the information which relates to the inclination of the line-segmented-waveform correspond to a plurality of different variation amount of voltage per a line-segmented-waveform as a variation amount of voltage in the line-segmented-waveform per a unit interval; therefore, it is possible to form a driving waveform in a curved waveform.

Also, in the above invention for a method for driving a liquid drop ejecting head, it is preferable that the line-segmented-waveform is formed by waveforms of which variation amount of voltage becomes smaller nearer an end section of the line-segmented-waveform.

According to the present invention, line-segmented-waveform is formed by waveforms of which variation amount of voltage becomes smaller nearer an end section of the driving waveform; therefore, there is not a sharp edge (a point in which a curve reverses rapidly). By doing this, operational status in the piezoelectric transducer changes gently; therefore, it is possible to restrict an increase in a load physically and thermally.

Also, in the above invention for a method for driving a liquid drop ejecting head, it is characterized in that the driving waveform contains an ejection waveform for ejecting the liquid drop and a micro-vibration waveform for causing a micro-vibration on the piezoelectric transducer such that the liquid drop is not ejected.

According to the present invention, it is possible to form not only an ejection waveform by which a liquid drop is ejected but also a micro-vibration waveform for causing a micro-vibration on the piezoelectric transducer for preventing an unstable ejection of a functional liquid due to desiccation and a clogging in a nozzle hole in a curved waveform. By doing this, it is possible to alleviate physical load and a thermal load which is caused by the physical load; thus, it is possible to restrict a deterioration in the piezoelectric transducer and a fatigue life of the piezoelectric transducer can be longer.

Also, in order to achieve the above object, it is characterized in that a method for forming a membrane by using a method for driving a liquid drop ejecting head according to the present invention.

According to the present invention, a membrane is formed according to a method for driving a liquid drop ejecting head by which less physical and thermal load is applied to the piezoelectric transducer in the liquid drop ejecting head. Therefore, it is possible to form a membrane by ejecting a liquid drop stably for a longer time; thus, it is possible to form a high quality membrane for a longer time.

Also, in the above invention, it is preferable that the above method for forming a membrane is used for manufacturing a membrane which becomes a part of a color filter.

According to the present invention, a color filter is manufactured according to a method for forming a membrane which can form a membrane stably for a longer time; therefore, it is possible to manufacture a high quality color filter cheaply which is formed by a membrane of which thickness, flatness, and disposition are more precisely controlled than in a conventional case.

Also, in the above invention, it is preferable that the above method for forming a membrane is used for forming a membrane which becomes a part of an organic electroluminescent element.

According to the present invention, an organic-electroluminescent element is manufactured according to a method for forming a membrane stably for a longer time; therefore, it is possible to manufacture a high quality organic electroluminescent element cheaply which is formed by a membrane of which thickness, flatness, and disposition are controlled more precisely than in a conventional case.

Also, in order to achieve the above object, it is characterized that an electronic apparatus is provided with a device which is manufactured by a method for forming a membrane according to the present invention.

According to the present invention, it is possible to propose an electronic apparatus which is provided with an electronic device or an optical device having a superior function and denser integration and which is formed by a membrane of which thickness, flatness, and disposition are controlled more precisely than in a conventional case; therefore, it is possible to provide an electronic apparatus by a lower cost quickly in which defect ratio is lower than in a conventional case.

Also, in order to achieve the above object, it is characterized in that a method for manufacturing a device according to the present invention by forming a functional liquid on a predetermined position of a base board uses a method for driving a liquid drop ejecting head according to the present invention and has a step for ejecting a functional liquid from the liquid drop ejecting head to a predetermined position of the base board.

According to the present invention, it is possible to manufacture a device which is formed by a membrane of which thickness, flatness, and disposition are controlled more precisely than in a conventional case; therefore, it is possible to provide a device having a superior function and denser integration by a lower cost quickly in which defect ratio is lower than in a conventional case.

As explained above, according to the present invention, it is possible to form line-segmented-waveforms by using a plurality of different variation amounts of voltage and combining the line-segmented waveforms and generate a driving waveform. Therefore, it is possible to drive a piezoelectric transducer by a curved driving waveform. In such a case, an expansion/contraction movement in the piezoelectric transducer becomes smooth; thus, it is possible to restrict an increase in a physical and thermal load to the piezoelectric transducer. By doing this, it is possible to prevent the piezoelectric transducer from being deteriorated; thus, longer fatigue life in the piezoelectric transducer is possible. Therefore, according to the present invention, there is an effect in that it is possible to eject a liquid drop from the liquid drop ejecting head stably for a longer time.

Also, according to the present invention, the line-segmented-waveform are formed by waveforms of which variation amount of voltage becomes smaller nearer an end section of the driving waveform; thus, it is possible to eliminate a point in which a curve reverses rapidly in a driving waveform (sharp edge). By doing this, a behavioral condition in the piezoelectric transducer becomes inactive; thus, an increase of physical and thermal load in the piezoelectric transducer can be restricted. Therefore, according to the present invention, it is possible to eject a stable liquid drop from a liquid drop ejecting head for a longer time.

DETAILED DESCRIPTION OF THE INVENTION

Figure 1:
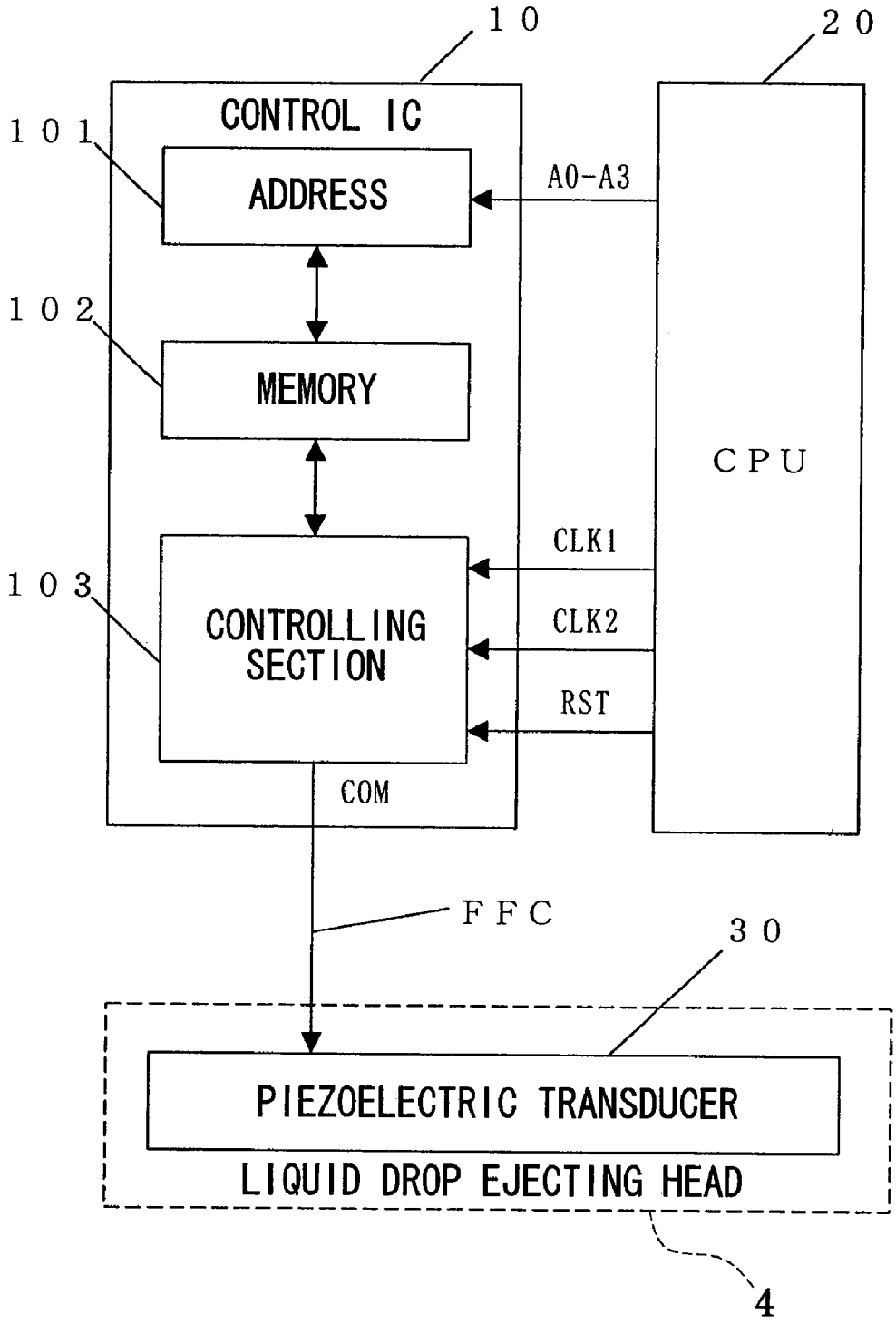
FIG. 1 is a block diagram showing a circuit structure in a device for driving a liquid drop ejecting head according to a first embodiment of the present invention.

An embodiment of the present invention is explained as follows with reference to drawings. FIG. 1 is a block diagram showing a circuit structure of a device for driving a liquid drop ejecting head according to the present embodiment. A shown in this drawing, a device for driving a liquid drop ejecting head according to the present embodiment comprises a control IC 10 as a controlling section and a memory, a CPU 20 for controlling the control IC 10, and a piezoelectric transducer 30 made of a piezo (PZT)-element which expands and contracts according to a driving waveform which is supplied from the control IC 10 and ejects a liquid drop from an ejecting section in a liquid drop ejecting head 4.

The control IC 10 serves as an IC exclusively having a function for generating a driving waveform for the piezoelectric transducer 30. The control IC 10 comprises an address space 101 having 4-bit-length such as A0 to A3, a memory 102 which corresponds to the address space 101, and a controlling section 103. A driving waveform is outputted from an output terminal COM in the controlling section 103 for driving the piezoelectric transducer 30. The output terminal COM and the piezoelectric transducer 30 are connected electrically by, for example, an FFC (flexible flat cable) and the like.

CPU is operated by executing a program which is stored in a ROM (read-only-memory) or a RAM (random-access-memory) which are not shown in the drawing. The CPU 20 designates address values such as A0 to A3 for the control IC 10, inputs various clocks (CLK 1, CLK 2), and perform a reset (RST) control. The CPU 20 generates a required driving waveform and drives the piezoelectric transducer 30 by controlling an address designation and a clock input.

Here, a driving waveform which is applied to the piezoelectric transducer 30 via the FFC from the control IC 10 can be categorized generally in an ejection waveform for ejecting a liquid drop from the liquid drop ejecting head 4 and a micro-vibration waveform for causing a micro-vibration on the piezoelectric transducer 30. In the ejection waveform, a maximum electric potential, a minimum electric potential, and a shape of the waveform are predetermined so as to eject a predetermined amount of the liquid drop. On the other hand, the micro-vibration waveform causes a micro-vibration on a surface of liquid (meniscus) of an ejected liquid (functional liquid) in a nozzle hole by vibrating the piezoelectric transducer 30 very finely so as to prevent an unstable ejection of the ejected liquid due to a desiccation of a liquid to be ejected in the nozzle hole in the liquid drop ejecting head 4 and a clogging such that the liquid drop is not ejected from the liquid drop ejecting head 4.

Here, the micro-vibration waveforms are categorized in following four waveforms according to a timing at which the micro-vibration waveform is applied to the piezoelectric transducer 30. That is, the micro-vibration waveforms are categorized in the four waveforms such as a normal micro-vibration waveform for always causing a micro-vibration on the piezoelectric transducer 30 under condition that the liquid drop ejecting device is turned on, a pre-ejection micro-vibration waveform for causing a micro-vibration on the piezoelectric transducer 30 before ejecting the liquid drop, a micro-vibration waveform during the ejection for causing a micro-vibration on the piezoelectric transducer 30 during the ejection of the liquid drop, and a post-ejection micro-vibration waveform for causing a micro-vibration on the piezoelectric transducer 30 after the liquid drop is ejected. Whether the ejection waveform or the micro-vibration waveform is applied to the liquid drop ejecting head 4 are determined by changing the address value (A0 to A3) which is outputted from the CPU 20 to the control IC 10 so as to change the inclination of the waveform and generate the micro-vibration waveform.

Next, an operation for generating a driving waveform in the control IC 10 according to the present embodiment is explained with reference to FIG. 2.

Figure 2:
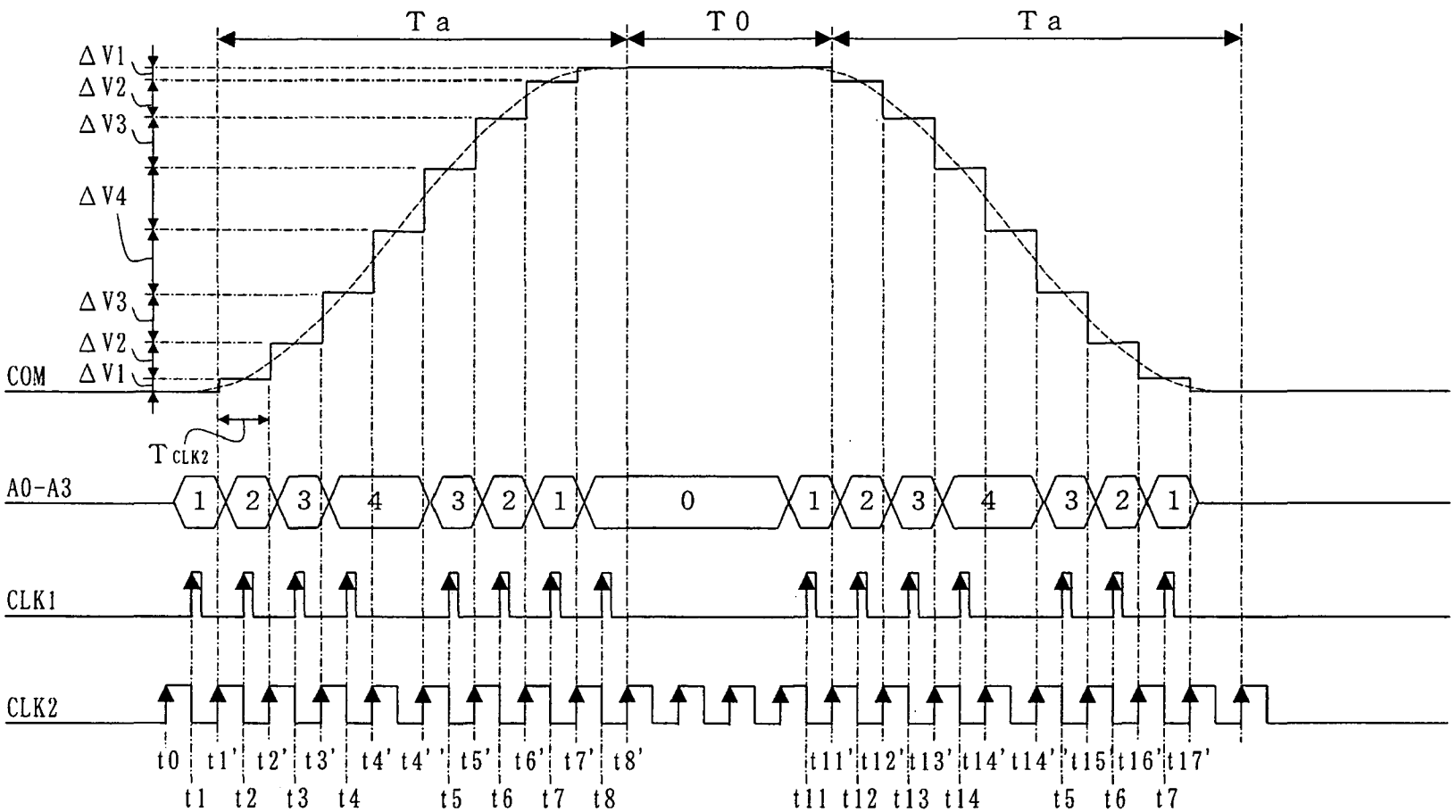
FIG. 2 is a timing chart for signals which are inputted to a controlling IC in a device for driving a liquid drop ejecting head according to the first embodiment of the present invention.

FIG. 2 is a timing chart at every terminal in the control IC 10. Here, an RST terminal is omitted in FIG. 2 because the RST terminal does not relate to this operation directly. In the drawing, a COM signal indicates an output line of the driving waveform. Signal lines A0 to A3 indicate an address input line. A signal line CLK 1 signal indicates a latch signal which latches the address in a standing portions. A signal line CLK 2 indicates an output timing signal for the driving waveform. A driving waveform is outputted from the COM terminal so as to synchronize the standing portion of the CLK 2.

The addresses 0 and 1 to 4 shown in a middle of FIG. 2 contain variation amount of voltage for indicating the inclination value which correspond to terms T0 and Ta of the output signal from each COM terminal. The addresses 0 and 1 to 4 correspond to $\Delta V0$ to $\Delta V4$ respectively. Here, a relationship such as $\Delta V0=0$, $\Delta V1<\Delta V2<\Delta V3<\Delta V4$ is effective.

First, the CPU 20 starts to output the CLK 2 signal having a frequency TCLK 2 to the control IC 10 at timing t0. The CPU 20 outputs the CLK 1 signal at timing t1 and latches the address 1. Here, an output timing for the CLK 1 signal is incorporated in an ROM as a timing data software. The CPU 20 outputs the CLK 1 signal at such a timing and latches the variation amount of voltage $\Delta V1$. By doing this, an electric potential at the COM terminal increases by $\Delta V1$ so as to synchronize with the standing portion (timing t1) of the CLK 2 signal. Similarly, the CPU 20 latches the addresses 2 to 4 by the CLK 1 signal at timings t2 to t4; thus, an electric potential at each COM terminal increase by $\Delta V2$ to $\Delta V4$.

Here, each variation amount of voltage satisfies a relationship such as $\Delta V1<\Delta V2<\Delta V3<\Delta V4$; therefore, the COM signal (driving waveform) increases gradually at timings t1 to t4. Next, after the variation amount of voltage $\Delta V4$ continues twice in the address 4, the variation amount of voltage gradually decreases in the timings t5 to t7 in a reverse manner to the timings t1 to t4. Also, the same operation as shown in the timings t1 to t7 is repeated after the timing t11.

Figure 16:
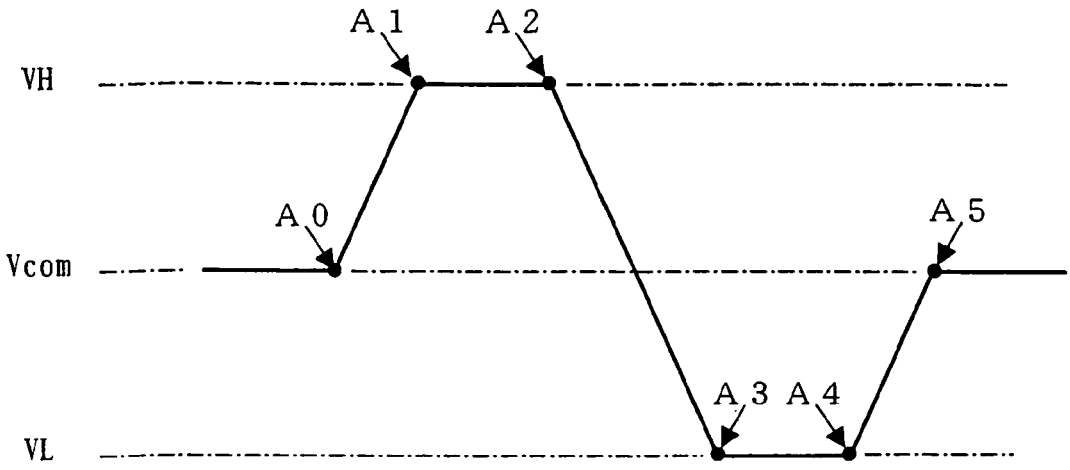
FIG. 16 (Prior Art)
FIG. 16 shows a driving waveform in a conventional piezoelectric transducer.
Figure 17:
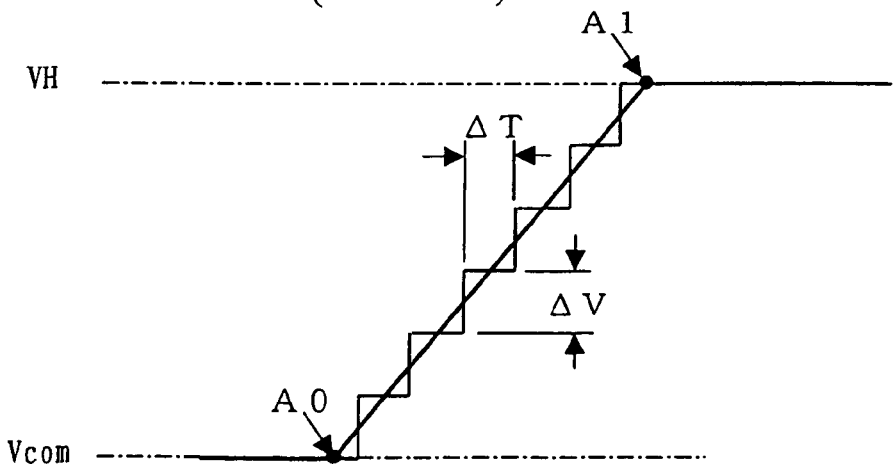
FIG. 17 (Prior Art)
FIG. 17 shows a driving waveform in a conventional piezoelectric transducer.

By doing this, in the driving waveform in the present embodiment, the variation amount of voltage $\Delta$ changes slightly; therefore, the waveform is formed in a quite smooth curve even though it is a digital driving waveform. On the other hand, the conventional driving waveform is formed in a trapezoid shape as shown in FIG. 16 in which variation points A0 to A5 have sharp edges (a point in which a curve reverses rapidly).

By doing this, according to a device for driving a liquid drop ejecting head according to the present embodiment, a driving waveform which is applied to the piezoelectric transducer 30 becomes a digital waveform having an approximate curved gradual waveform when the driving waveform is generated; therefore, it is possible to drive the piezoelectric transducer 30 by a waveform which is entirely a gradual curve in a macro-point of view reliably free from unstable factors such as a resistance in an FFC which is connected to the piezoelectric transducer 30 and parasite capacity.

Therefore, according to a device for driving a liquid drop ejecting head, it is possible to drive the piezoelectric transducer 30 by a waveform which is entirely a gradual curve in a macro-point; therefore, it is possible to reduce more physical load and a more thermal load which is caused by the physical load than in a case in which the liquid drop ejecting head is driven by a trapezoid square waveform. Therefore, it is possible to extend a fatigue life of the piezo electric transducer 30 by restricting the deterioration in the piezoelectric transducer 30. Therefore, it is possible to eject the liquid drop stably for a longer time from the liquid drop ejecting head by a device for driving a liquid drop ejecting head according to the present embodiment.

Figure 3A:
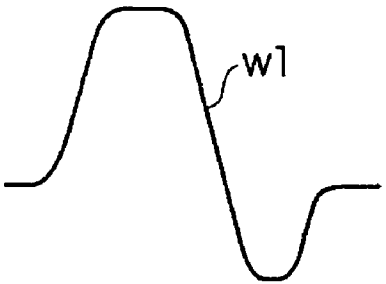
FIGS. 3A to 3C show examples for an approximate curved driving waveform and a micro-vibration waveform.
Figure 3B:
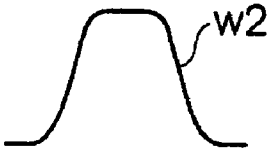
Figure 3C:
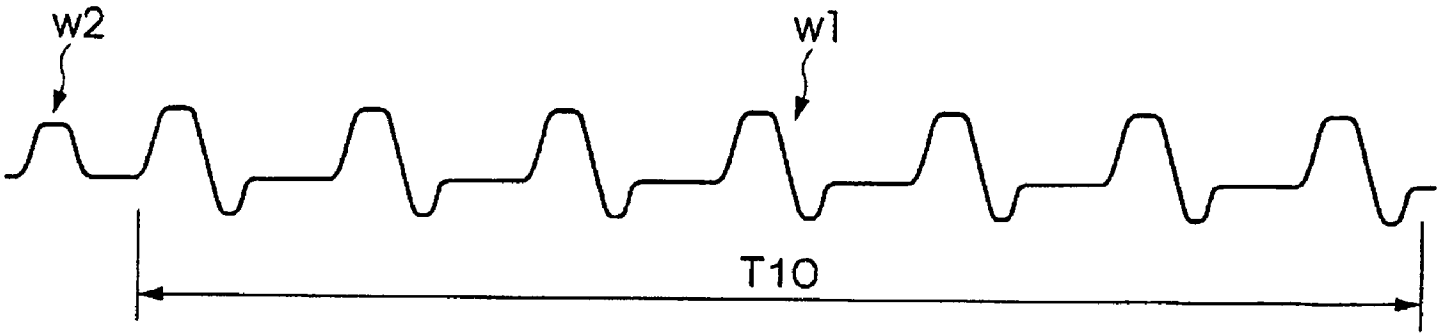

A method for driving the piezoelectric transducer 30 by using the driving waveform by generating a driving waveform having an approximate curve is explained as above. As explained above, a driving waveform can be categorized generally in an ejection waveform for ejecting a liquid drop and a micro-vibration waveform for preventing an unstable ejection and clogging in the nozzle hole. A method for forming a curved driving waveform can be used not only for forming a curved ejection waveform but also for forming a curved micro-vibration waveform. FIGS. 3A to 3C show examples for an approximate curved driving waveform and an approximate curved micro-vibration waveform. FIG. 3A shows an approximate curved ejection waveform. FIG. 3B shows an approximate micro-vibration waveform. FIG. 3C shows an approximate curved waveform obtained by synthesizing the approximate curved ejection waveform and the approximate micro-vibration waveform.

As shown in FIG. 3A, an ejection waveform w1 is formed in an approximate curved waveform from a macro-point of view. Also, as shown in FIG. 3B, a micro-vibration waveform w2 is formed in an approximate curved waveform from a macro-point of view as similar to the ejection wave form w1. Also, in FIG. 3C, the micro-vibration waveform w2 is supplied to the piezoelectric transducer 30 before an liquid drop ejecting period T10. Also, in FIG. 3C, an example of a driving waveform is explained in which only the ejection waveform w1 is supplied to the piezoelectric transducer 30 in the liquid drop ejecting period T10. Here, it is not that only the micro-vibration waveform (pre-ejection micro-vibration waveform) before the liquid drop ejecting period T1 shown in FIG. 3C is formed in an approximate curve. The normal micro-vibration waveform, the micro-vibration waveform during the ejection, and the post-ejection micro-vibration waveform which are explained above are formed in approximate curved waveforms from a macro-point of view.

By doing this, according to a device for driving a liquid drop ejecting head according to the present embodiment, the micro-vibration waveform is formed in an approximate curved digital waveform; therefore, it is possible to reduce more physical load and a thermal load which is caused by the physical load than in a case in which the liquid drop ejecting head is driven by a trapezoid square waveform. Thus, it is possible to extend a fatigue life of the piezoelectric transducer 30 by restricting the deterioration in the piezoelectric transducer 30.

Figure 4:
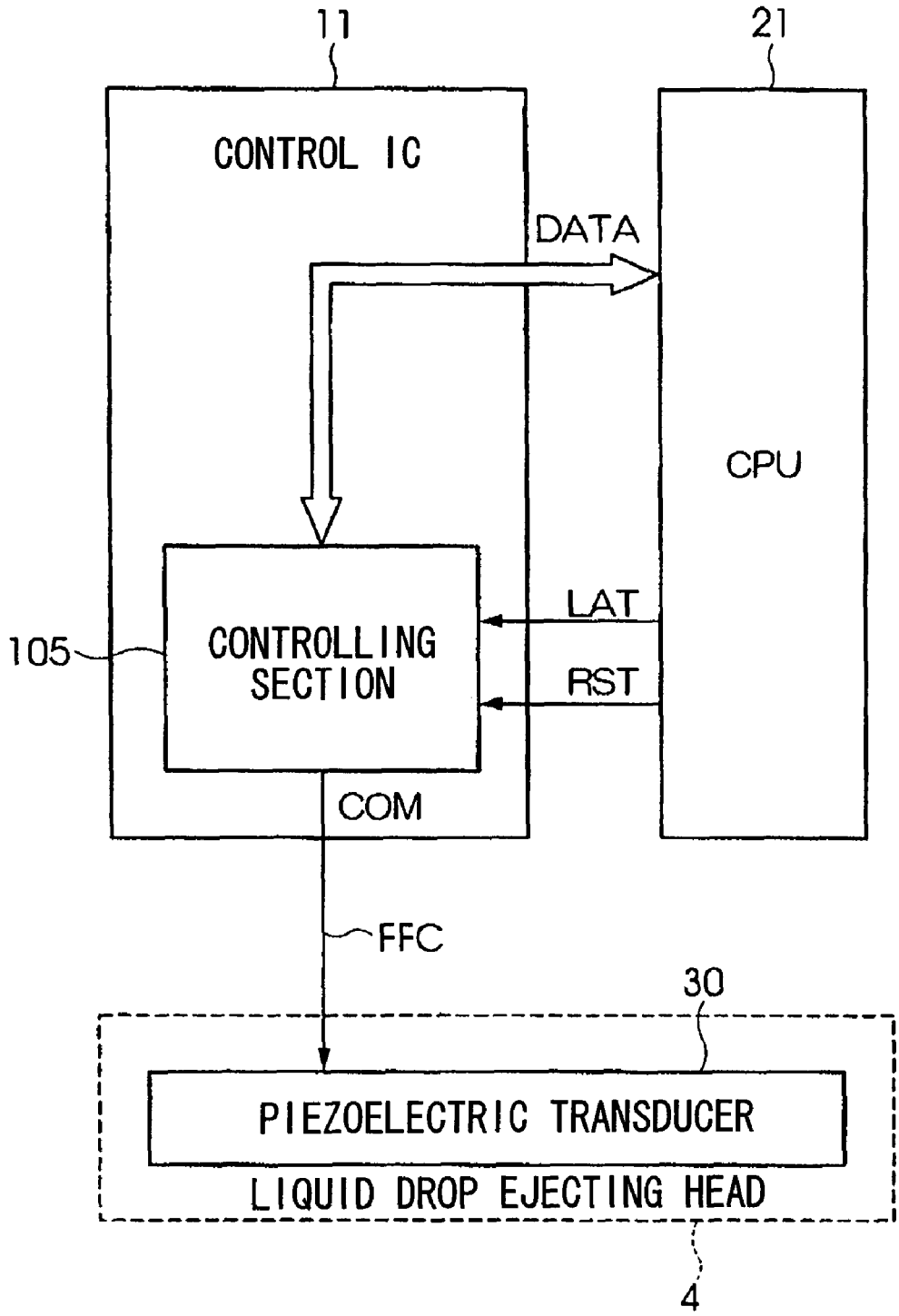
FIG. 4 is a block diagram showing a circuit structure in a device for driving a liquid drop ejecting head according to other embodiments of the present invention.

Next, other embodiment is explained. FIG. 4 is a block diagram showing a circuit structure in the device for driving a liquid drop ejecting head according to other embodiment of the present invention. A device for driving a liquid drop ejecting head according to an embodiment of the present invention shown in FIG. 1 uses a control IC 10 which is provided with a memory 102. In contrast, a device for driving a liquid drop ejecting head according to the other embodiment of the present invention shown in FIG. 4 is different from a case shown in FIG. 1 in that a device for driving a liquid drop ejecting head according to the other embodiment of the present invention shown in FIG. 4 is provided with a control IC 11 which is not provided with a memory.

The device for driving a liquid drop ejecting head shown in FIG. 1 stores an information which relates to the inclination of the line-segmented-waveform which forms the driving waveform in the memory 102 in advance, and selects the inclination value of the line-segmented-waveform which is stored in the memory 102 according to the address value which is applied from the CPU 10 to the control IC 10 vial the signal lines A0 to A3. However, in such a structure, the inclination value of the line-segmented-waveform of the driving waveform is limited.

Therefore, in the present embodiment, the information which relates to the inclination value of the line-segmented-waveform for generating the driving waveform is outputted to the control section 1 in the control IC 11 from the CPU 21 via, for, example, 10 bit data line DATA. The control section 105 latches this information when a latch signal LAT is outputted from the CPU 21; thus, a driving waveform having the inclination value of the line-segmented-waveform which is designated by the CPU 21 is generated. Here, the control section 105 generates the ejection waveform or the micro-vibration waveform according to the information which is inputted from the CPU 21 via the data line DATA for generating an ejection waveform which is a kind of driving waveform or a micro-vibration waveform which is a king of a driving waveform.

Here, as shown in FIG. 2, a plurality of different variation amounts of voltage ΔV1 to ΔV4 are used for generating an approximate curved driving waveform. These different variation amounts of voltage ΔV1 to ΔV4 are outputted to the control section 103 in the control IC 11 from the CPU 21 consecutively. That is, the CPU 21 outputs a plurality of different variation amounts of voltage ΔV1 to ΔV4 to the control IC 11 for generating a line-segmented-waveform in, for example, a period Ta. By forming a circuit structure as shown in FIG. 4, the inclination of the driving waveform which can be generated by the device for driving a liquid drop ejecting head is not limited; thus, it is possible to generate a driving waveform having a any desirable waveform. By doing this, it is surely possible to stabilize the ejection of the liquid drop and extend a fatigue life in the piezoelectric transducer 30. Also, it is possible to use such a structure more commonly; thus, it is possible to use such a structure for manufacturing various devices and for forming a membrane.

(Example of Embodiment)

Figure 5:
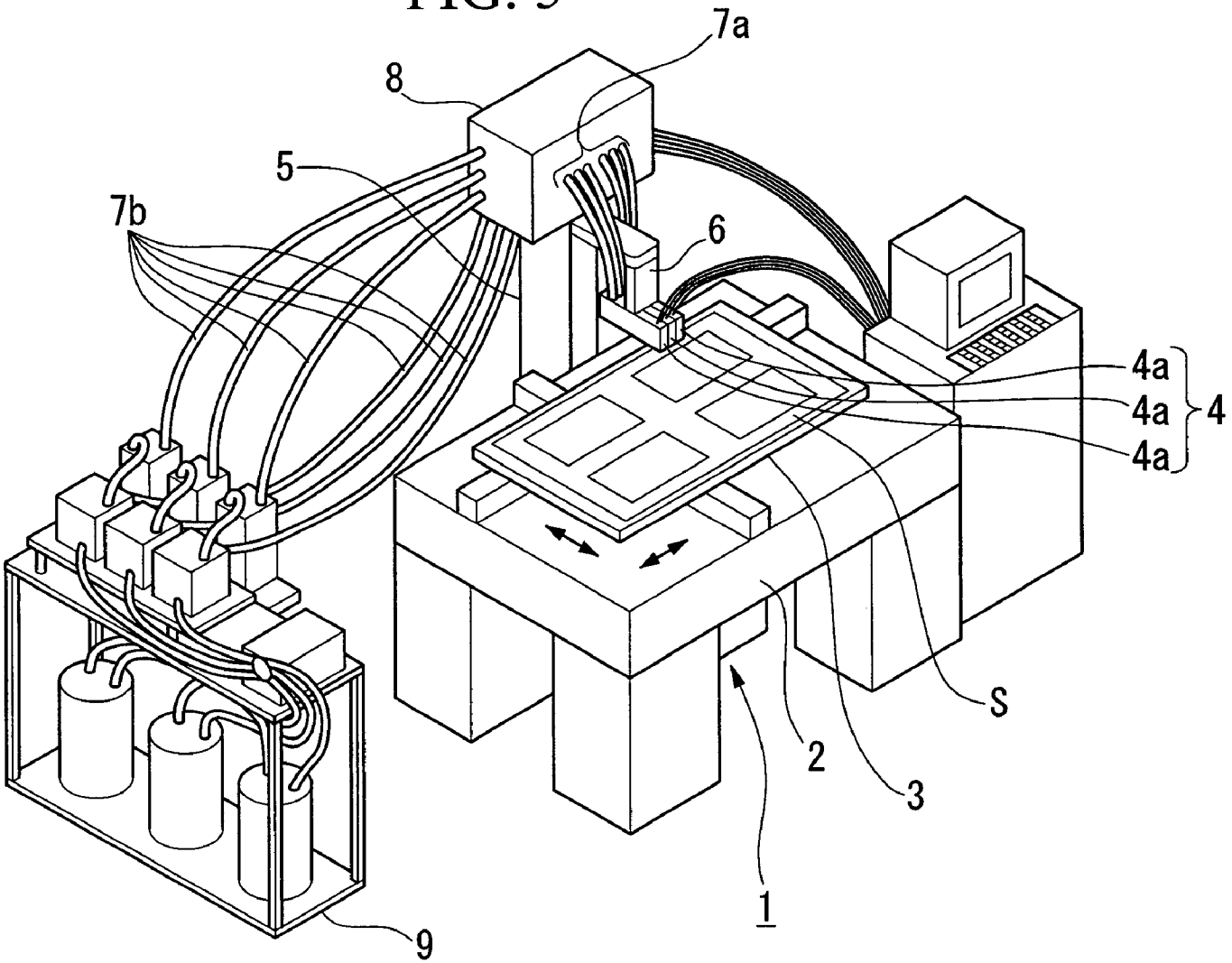
FIG. 5 is a perspective view showing a general structure of a device for forming a membrane according to the present invention.

A device (a liquid drop ejecting device) for forming a membrane which is provided with a device for driving a liquid drop ejecting head according to the above embodiment is explained with reference to FIG. 5. FIG. 5 is a perspective view showing a general structure of a device for forming a membrane according to the present embodiment. The device 1 for forming a membrane is used, for example, for manufacturing a color filter. The device 1 for forming a membrane is provided with an XY table 3 which is carried on a base mount 2 so as to freely move in an X direction and in a Y direction and a liquid drop ejecting head 4 which is provided above the XY table 3.

A base board S is mounted on which, for example, a black matrix is formed under non-colored condition the XY table 3. The liquid drop ejecting head 4 is attached to a support member 6 which is formed on a mount 5. The liquid drop ejecting head 4 is provided with independent heads 4*a* . . . for ejecting color ink such as red, blue, and green. An ink supply tube 7 and an electric signal cable (such as an FFC which is not shown in the drawing) are connected to each head 4*a* . . . independently.

An ink supply unit 9 is connected to the other end of the ink supply tube 7 via a valve box 8 which contains a three-way-valve and a dissolved oxygen analyzer.

By such a structure, the device for forming a membrane transports the ink contained in a tank to the liquid drop ejecting head 4 via the ink supply tube 7*b*, a valve box 8, and an ink supply tube 7*a* so as to eject the ink from the liquid drop ejecting head 4 and applies it on the base board S.

Consequently, the device 1 for forming a membrane is provided with a device for driving a liquid drop ejecting head having less physical load and thermal load to the piezoelectric transducer 30 as shown in FIG. 1; thus, it is possible to eject a liquid drop stably for a longer time.

In order to eject the ink on the base board S so as to manufacture a color filter by using such a device 1 for forming a membrane, first, a base board S is disposed on a predetermined position of the XY table 3. For such a base board S, a transparent base board having a high transparency for a light and adequate physical strength is used. More specifically, a transparent glass base board, an acrylic glass member, a plastic base board, a plastic layer, and these members of which surface is preferably processed can be used.

Figure 6:
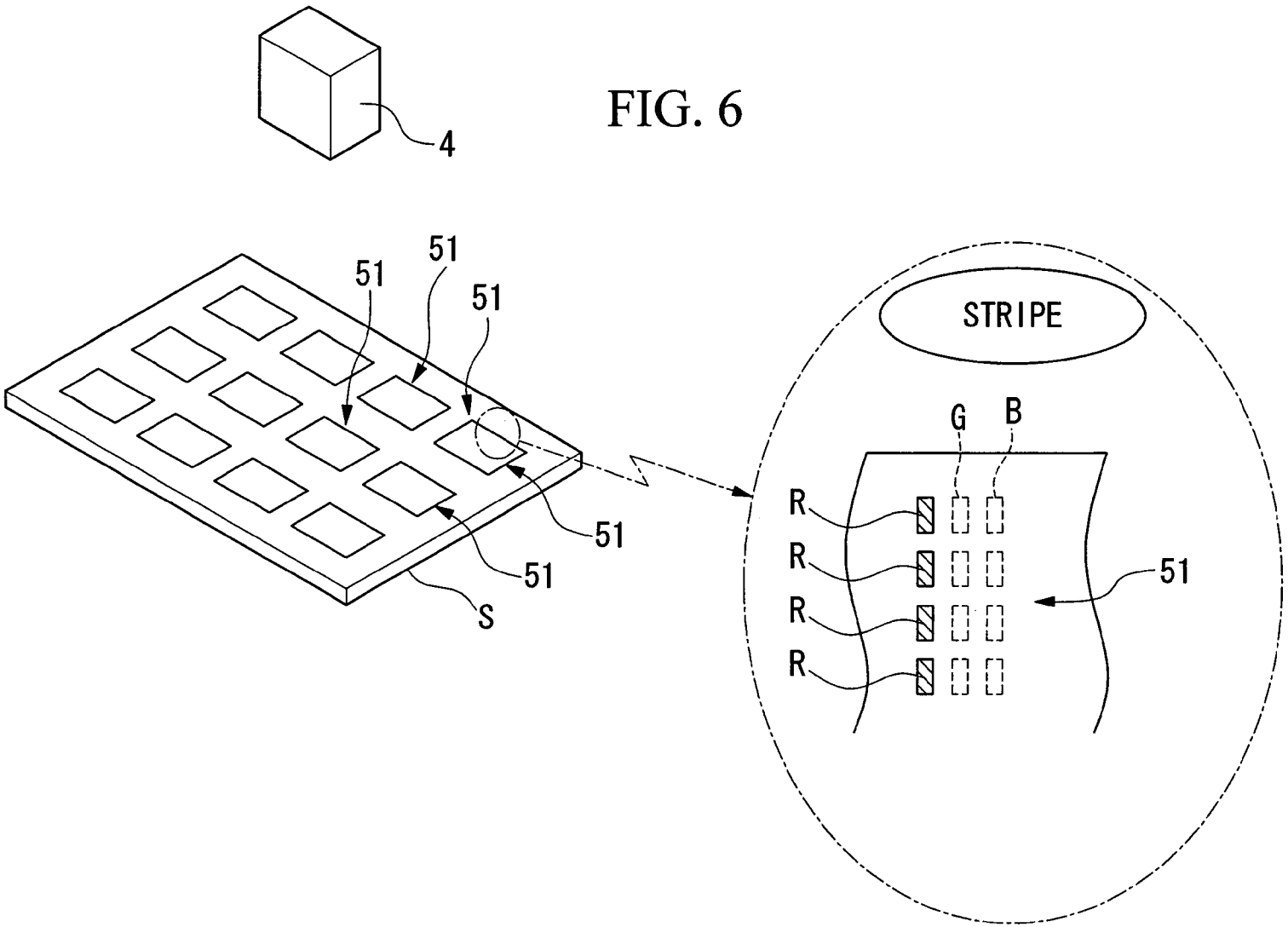
FIG. 6 shows a color filter area on a base board.

Also, in the present example of the embodiment, a plurality of color filter areas 51 are formed in a matrix manner on the base board S having a rectangular shape as shown in FIG. 6 from a production efficiency point of view. By cutting the base board S later, it is possible to use these color filters 51 preferably for a liquid display device. Here, these color filter areas 51 are formed by disposing a red ink, a green ink, and a blue ink in a predetermined pattern such as, in this example of the embodiment, a conventional stripe pattern as shown in FIG. 6. It may be acceptable if the color filter areas 51 are formed by a mosaic pattern, a delta pattern, or a square pattern other than the stripe pattern.

Figure 7A:
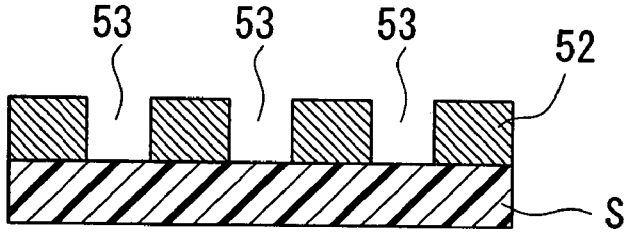
FIGS. 7A to 7F are cross sections for explaining manufacturing steps for forming the color filter area according to a manufacturing order.

For forming such color filter areas 51, first, a black matrix 52 is formed on a surface of the base board S as shown in FIG. 7A. The black matrix 52 is formed by applying a resin (black resin is preferable) which does not have a light-transparency in a predetermined thickness (for example, approximately 2 μm) by using a method such as a spin-coat method. In a minimum display element which is surrounded by a lattice of the black matrix 52 such as a filter element 53, width in an X axis direction is approximately 30 μm, and a length in a Y axis direction is approximately 100 μm.

Figure 7B:
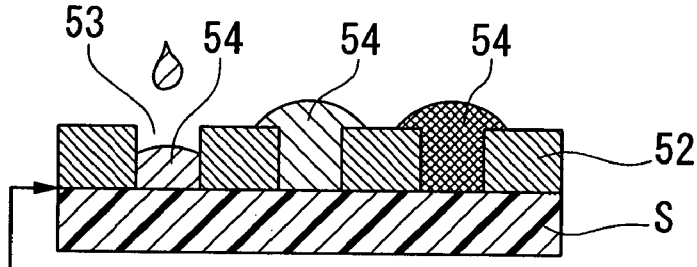

Next, as shown in FIG. 7B, an ink drop (liquid drop) 54 is ejected from the liquid drop ejecting head 4 and the ink drop 54 reaches at the filter element 53. Here, the ink drop 54 is ejected preferably sufficient under condition that it is considered that a volume of the inc drop decreases in a heating process.

Figure 7C:
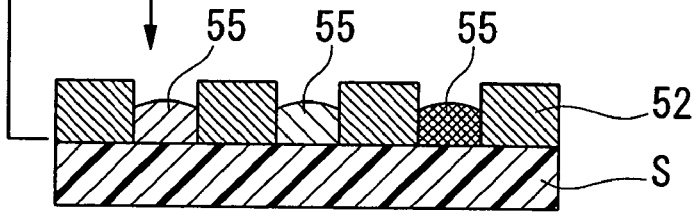

In this way, after the ink drop 54 is filled in all of the filter elements 53 on the base board S, the base board S is heated by a heater until a temperature of the base board S reaches at a predetermined temperature (for example, approximately 70°). By such heating process, a solvent in the ink evaporates; thus, a volume of the ink decreases. When a volume of the ink decreases greatly, an ink ejecting process and a heating process are repeated until a sufficient thickness for an ink layer is formed for a color filter. By such operations, the solvent which is contained in the ink evaporates; thus, a solid component which is contained in the ink remains and forms a layer finally. Thus, a color filter 55 is formed as shown in FIG. 7C.

Figure 7D:
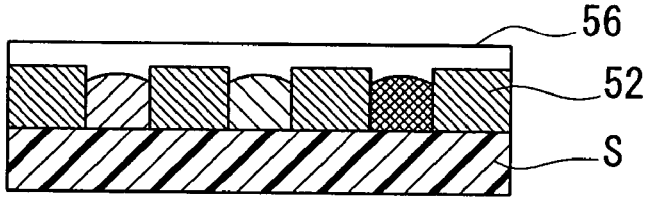

Next, for purposes of flattening the base board S and protecting the color filter 55, a protecting layer 56 is formed on the base board S so as to cover the color filter 55 and the black matrix 52 as shown in FIG. 7D. Here, it is possible to form the protecting layer 56 by methods such as a spin coat method, a roll coat method, or a dipping method. Also, it is possible to form the protecting layer 56 by using a device 1 for forming a membrane similarly to a case of the color filter 55 as shown in FIG. 5.

Figure 7E:
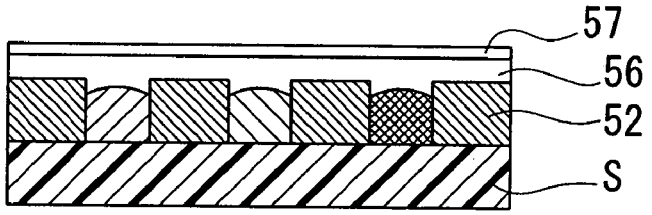
Figure 7F:
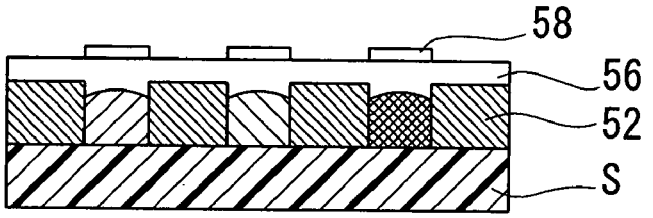

Next, a transparent conductive layer 57 is formed on an entire surface of the protecting layer 56 by a method such as a spattering method and a vapor deposition method as shown in FIG. 7E. After that, the transparent conductive layer 57 is patterned, and a pixel electrode 58 is also patterned so as to correspond to the filter element 53. Here, if a TFT (thin film transistor) is used for driving a liquid crystal display panel, such patterning operation is not necessary.

A color filter is manufactured by the device 1 for forming a membrane which can eject a liquid drop stably for a longer time; thus, it is possible to manufacture a high quality color filter which is made of a layer of which thickness, flatness, and disposition are controlled more precisely than in a conventional case.

Here, a structure of the device 1 for forming a layer according to the present invention is not limited to a structure shown in FIG. 5. It is not necessary that a structure in the liquid drop ejecting head 4 is limited to a structure that the liquid drop ejecting head 4 is provided with three heads 4*a*.

Figure 8:
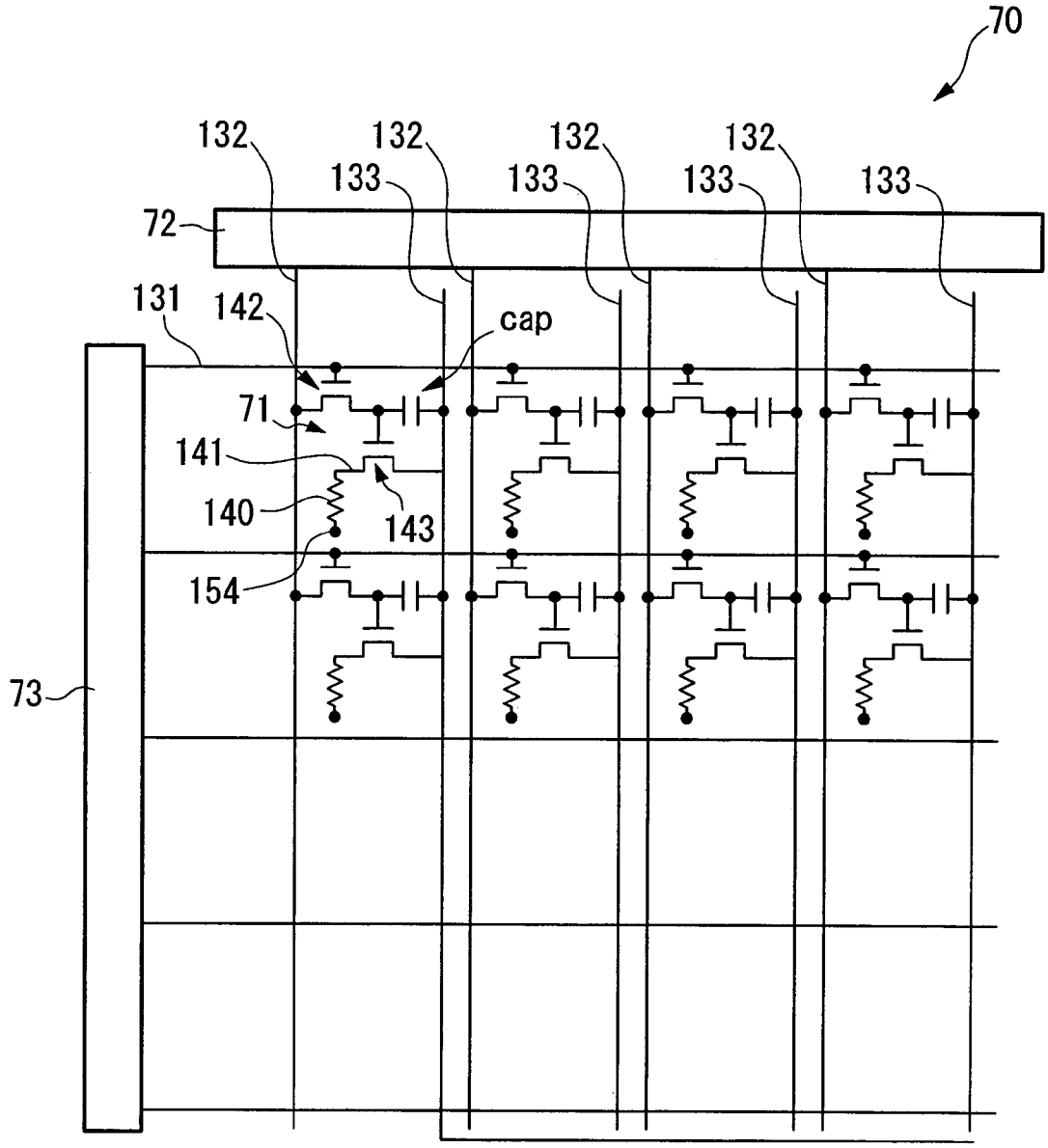
FIG. 8 is an example for a circuit diagram of an EL display which is provided with an organic EL element.
Figure 9:
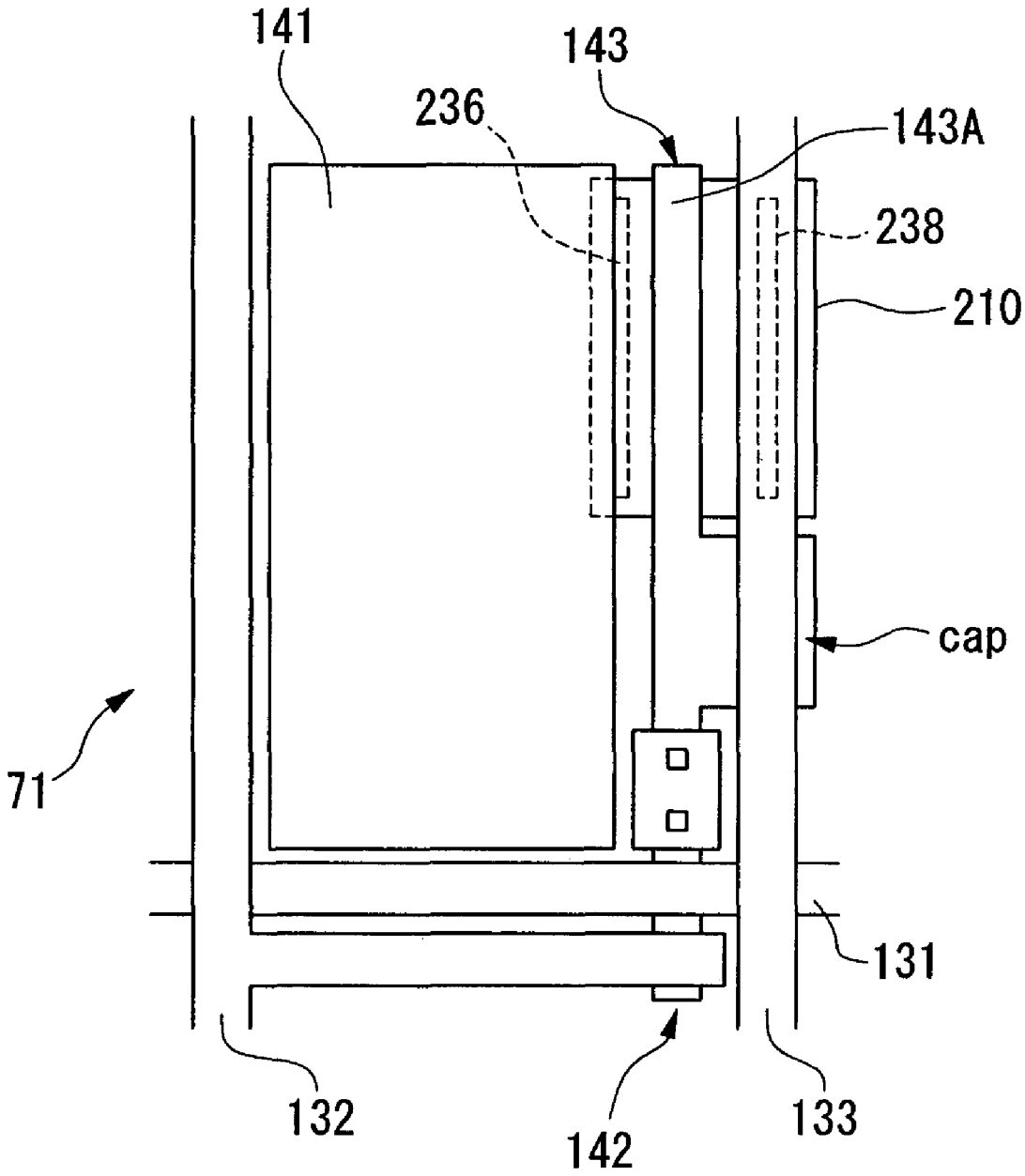
FIG. 9 is a magnified plan view for showing a plan structure of a pixel element section in the EL display shown in FIG. 8.

Also, the device 1 for forming a membrane can be used for forming a thin layer which forms an organic EL element. FIGS. 8 and 9 show an example for an EL display which is provided with such an organic EL element. In these drawings, reference numeral 70 indicates an EL display.

The EL display 70 is formed by disposing wirings such as a plurality of scanning lines 131, a plurality of signal lines 132 which expand in a direction orthogonal to these scanning lines 131, and a plurality of common power supply lines which expand in serial with these signal lines 132 on a transparent base board as shown in a circuit diagram in FIG. 8. Here, a pixel element (pixel area element) 71 is disposed in each cross point of the scanning line 131 and the signal line 132.

A data driving circuit 72 which is provided with a shift register, a level shifter, an analogue switch is connected to the signal lines 132.

On the other hand, a scan driving circuit 73 which is provided with a shift register and a level shifter is connected to the scanning lines 131. Also, are disposed in each pixel area 71 a switching thin film transistor 142 to which gate electrode a scanning signal is supplied via the scanning line 131, a retaining capacity cap for retaining an image signal which is supplied through the signal line 132 via the switching thin film transistor 142, a current thin film transistor 143 to which gate electrode the image signal which is retained in the retaining capacity cap is supplied, a pixel electrode 141 to which a driving electric current flows through the current power supply line 133 when the pixel electrode 141 is connected to the common power supply line 133 via the current thin film transistor 143, and an illuminating section 140 which is sandwiched by the pixel electrode 141 and a reflecting electrode 154.

The scanning line 131 is driven and the switching thin film transistor 142 is turned on under such above condition; thus, an electric potential in the signal line 132 under this condition is retained in the retaining capacity cap. Whether the current thin film transistor 143 is turned on or off depends on the status in the retaining capacity cap. Consequently, an electric current flows from the common power supply line 133 to the pixel electrode 14 via a channel in the current thin film transistor 143. Furthermore, an electric current flows into the reflecting electrode 154 via the illuminating section 140; thus, the illuminating section 140 illuminates according to the electric current which flows therethrough.

Here, in a plan view of each pixel 71, four members of the pixel electrode 141 having a rectangular plan shape are surrounded by the signal line 132, the common power supply line 133, the scanning line 131, and other scanning line which is used for other pixel electrode which is not shown in the drawing respectively as shown in FIG. 9 which is a magnified view in which the reflecting electrode and the organic EL element are not shown.

Next, a method for manufacturing an organic EL element which is provided in an EL display 70 is explained with reference to drawings 10A to 12C. Here, explanations are made for a case in which one piece of pixel 71 is disposed so as to simplify the description of the FIGS. 10A to 12C.

First, a base board is prepared. Here, in an organic EL element, it is possible to extract a light which is emitted from an illuminating layer which is explained later from the base board. Also, it is possible to extract a light from an opposite side to the base board. In a case in which the illuminating light is extracted from the base board, a transparent member or a translucent member such as a glass member, a silica member, and a resin can be used for forming the base board. Here, a cheap glass member is used particularly preferably.

Also, it may be acceptable if the illuminating light is controlled by disposing a color filter or a color converting layer which contains a fluorescent member, or a dielectric reflecting layer on the base board.

Also, in a case in which an illuminating light is extracted from opposite side of the base board, it is acceptable if the base board is opaque. In such a case, it is possible to use a ceramic sheet such as an alumina sheet or a stainless metal sheet which are processed to be insulative by oxidizing the surface of them, a thermo setting resin, and a thermo plastic resin.

Figure 10A:
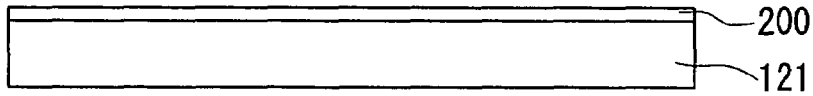
FIGS. 10A to 10E are cross sections for explaining a manufacturing method for an organic EL element according to a manufacturing order.

In the present example of embodiments, a transparent base board 121 which is made of a glass member or the like is prepared for a base board as shown in FIG. 10A. Consequently, a surface protecting layer (not shown in the drawings) which is made of approximately 200 to 500 nm of thickness of a silicon oxide layer is formed on the transparent base board 121 by performing a plasma CVD method in which a TEOS (tetraethoxysilane) and an oxygen gas is used for a member for forming the surface protecting layer according to necessity.

Next, a temperature of the transparent base board is set at 350° C., and under this condition, a semiconductor layer 200 which is made of an amorphous silicon layer having 30 to 70 nm of thickness is formed on a surface of the surface protecting layer by a plasma CVD method. Next, the semiconductor layer 200 is crystallized so as to form a poly silicon layer by performing a laser annealing method or a solid phase growth method to the semiconductor layer 200.

In the laser annealing method, a excimer laser line beam having 400 mm of longitudinal length is used with 200 mJ/cm$^2$ of output intensity. The line beam is scanned such that approximately 90% of peak intensity of the laser in a latitudinal direction overlaps each area.

Figure 10B:
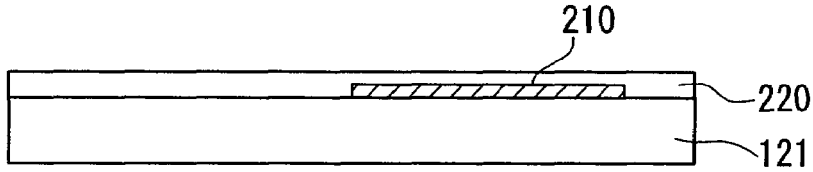
Figure 10C:
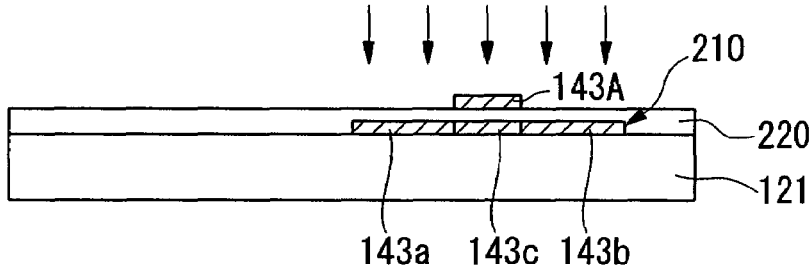

Next, as shown in FIG. 10B, the semiconductor layer 200 (poly silicon layer) 200 is patterned so as to be an insular semiconductor layer 210. A gate insulating layer 220 which is made of a silicon oxide layer or a nitride layer having thickness of approximately 60 to 150 nm is formed on a surface of the insular semiconductor layer 210 by a plasma CVD method by using a TEOS or an oxygen gas for a member for forming the gate insulating layer 220. Here, the semiconductor layer 210 becomes a channel area and a source drain area on the current thin film transistor 143 shown in FIG. 9. A semiconductor layer which becomes a channel area and a source drain area on the switching thin film transistor 142 is formed in a different cross section. That is, in the manufacturing processes shown in FIGS. 10A to 12C, two transistors 142 and 143 are manufactured simultaneously. Both transistors 142 and 143 are manufactured according to the same manufacturing steps as each other; thus, explanation for the transistors is made only for a current thin film transistor 143, and explanation for the switching thin film transistor 142 is omitted.

Next, a conductive layer made of a metal member such as aluminum, tantalum, molybdenum, titanium, tungsten is formed by performing a spattering method. After that, the conductive layer is patterned; thus, a gate electrode 143A is formed.

Next, a highly dense phosphorus ion is implanted to the gate electrode 143A. A source drain areas 143*a* and 143*b* are formed on the semiconductor layer 210 so as to face the gate electrode 143A in a self-aligning manner. Here, an area to which an impurity is not introduced becomes a channel area 143*c*.

Figure 10D:
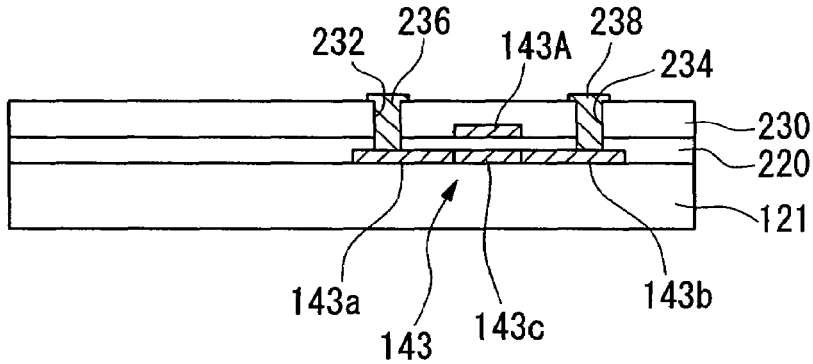

Next, after an interlayer insulating layer 230 is formed, contact holes 232 and 234 are formed as shown in FIG. 10D. Consequently, relay electrodes 236 and 238 are embedded in the contact holes 232 and 234.

Figure 10E:
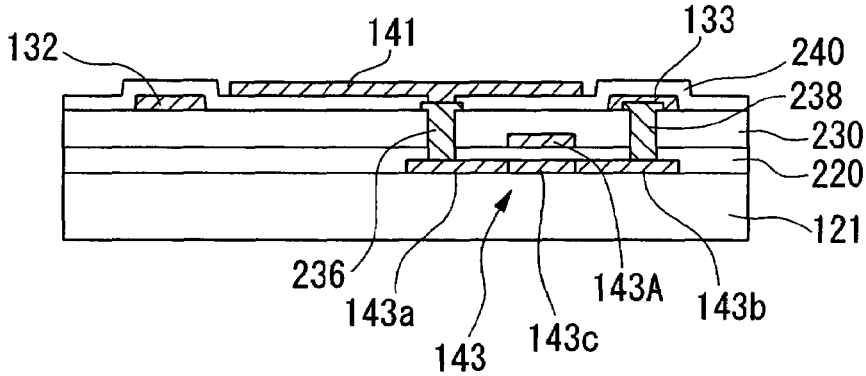

Next, the signal line 132, the common power supply line 133, and the scanning line (not shown in FIGS. 10A to 10E) are formed on the interlayer insulating layer 230 as shown in FIG. 10E. Here, it is acceptable if the relay electrode 238 and each wiring are formed in the same manufacturing step. In such a case, the relay electrode 236 is formed by an ITO (Indium Tin Oxide) layer which is explained later.

In addition, an interlayer insulating layer 240 is formed so as to cover a surface of each wiring. Contact holes (not shown in the drawings) are formed so as to correspond to the relay electrode 236. An ITO layer is formed so as to be embedded in the contact hole. Furthermore, the ITO layer is patterned. A pixel electrode 141 which is connected to the source drain area 143*a* electrically is formed in a predetermined position which is surrounded by the signal line 132, the common power supply line 133, and the scanning line (not shown in the drawing). Here, as explained later, a positive hole injection layer and an illuminating layer is formed in an area which is sandwiched by the signal line 132, the common power supply line 133, and furthermore the scanning line (not shown in the drawing).

Figure 11A:
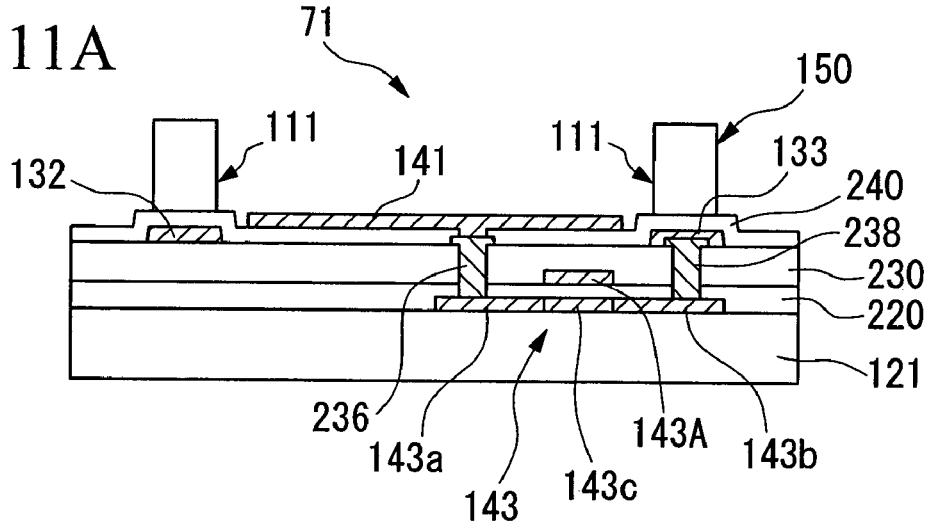
FIGS. 11A to 11C are cross sections for explaining a manufacturing steps which follow the process shown in FIGS. 10A to 10E.

Next, a partition wall 150 is formed so as to surround the above area where a positive hole injection layer and an illuminating layer are formed as shown in FIG. 11A. This partition wall 150 serves as a separating member. It is preferable that the partition wall 150 is formed by an insulating organic member such as a polyimide. The partition wall 150 is formed such that its thickness should be, for example, 1 to 2 $\mu$m. Also, it is preferable that the partition wall 150 indicates non-affinity to a liquid member which is ejected from the liquid drop ejecting head 4. In order to realize the non-affinity in the partition wall 150, for example, a method in which a surface of the partition wall 150 is processed by a fluorine compound is employed. For such a fluorine compound, it is possible to name $CF_4$, $SF_5$, $CHF_3$ and the like. Also, it is possible to name a plasma processing method, a UV emitting method, and the like for such a method for processing the surface.

By doing this, a gap 111 having a sufficient height is formed in an area where the positive hole injection layer and the illuminating layer are formed such as between a position to which members for forming the positive hole injection layer and the illuminating layer are applied and a peripheral partition wall 150.

Figure 11B:
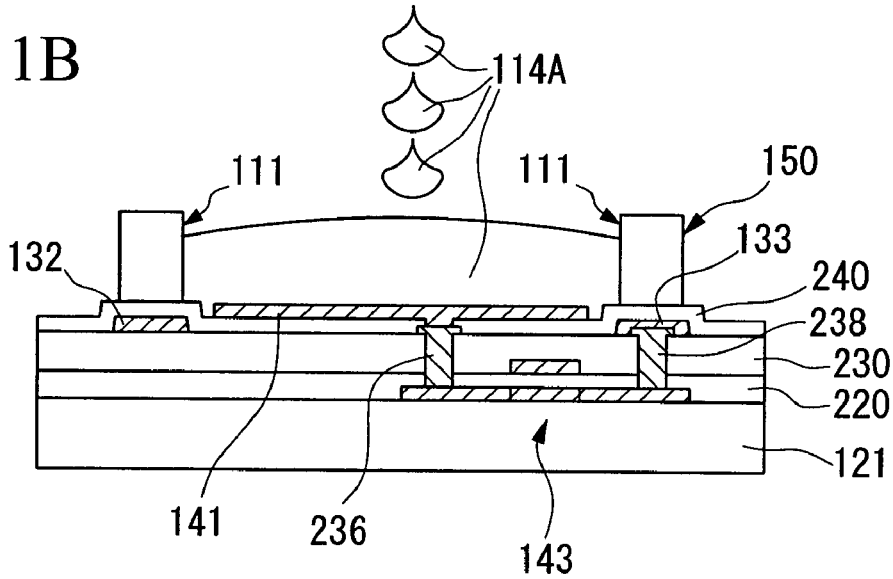

Next, a member for forming the positive hole injection layer is applied to an applying position which is surrounded by the above partition wall 150 such as an inner area of the partition wall 150 selectively from the above liquid drop ejecting head 4 under condition that an upper surface of the base board 121 is disposed upwardly as shown in FIG. 11B.

For a member for forming the positive hole injection layer, it is possible to name a polyphenylenevinylene of which polymer precursor is a polytetrahydrothiophenylphenylene, 1,1-bis-(4-N,N-ditolylaminophenyl)cyclohexane, a tris(8-hydroxyquinolinol) aluminum, and the like.

Under such a condition, a liquid member 114A for forming the positive hole injection layer is so liquid that a liquid member 114A for forming the positive hole injection layer tends to expand horizontally. In such a case, the partition wall 150 is formed so as to surround the applying position; thus, it is possible to prevent the liquid member 114A for forming the positive hole injection layer from expanding over the partition wall 150 further thereoutside.

Figure 11C:
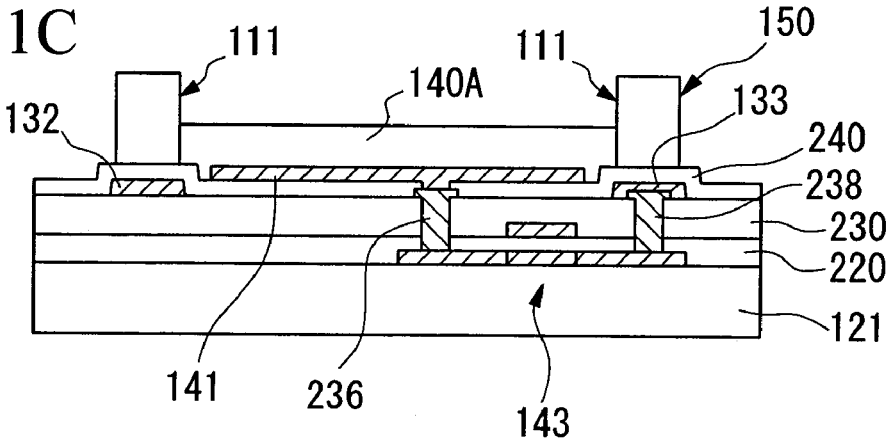

Next, a solvent in a liquid precursor 114A is evaporated by heating it of emitting a light so as to form a solid positive hole injection layer 140B on the pixel electrode 141 as shown in FIG. 11C.

Figure 12A:
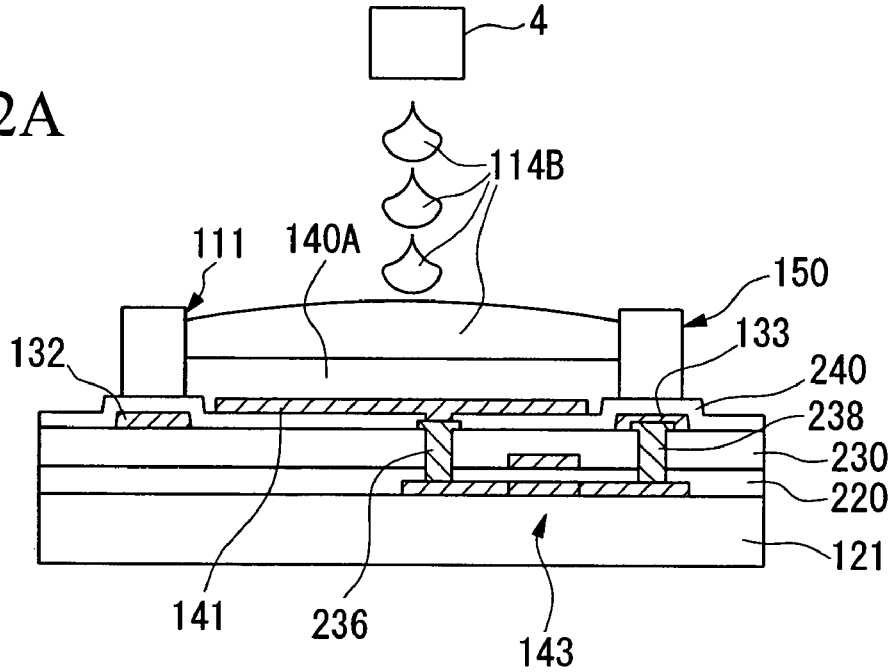
FIGS. 12A to 12C are cross sections for explaining a manufacturing steps which follow the process shown in FIGS. 11A to 11C.

Next, a member 114*b* (illuminating member) for forming an illuminating layer as an ink is applied on the positive hole injection layer 140A in the partition wall 150 selectively from the liquid drop ejecting head 4 under condition that an upper surface of the base board 121 is disposed upwardly as shown in FIG. 12A.

For a member for forming the illuminating layer, it is preferable to use, for example, a member which contains a precursor of conjugated polymer organic compound and a fluorescent color element for changing the illuminating characteristics in the illuminating layer which is obtained.

The precursor of conjugated polymer organic compound can be represented by a member which can generate an illuminating layer which becomes a conjugated polymer organic EL layer after heated and hardened after the member which can generate an illuminating layer is ejected from the liquid drop ejecting head 4 with the fluorescent color element so as to be formed in a thin film. For example, in case of a precursor of a sulfonium salt, a sulfonium group is removed by heating operation; thus, the precursor of a sulfonium salt becomes a conjugated polymer organic compound.

Such a conjugated polymer organic compound is under a solid condition and emits an intense illumination; thus, it is possible to produce a uniform solid super thin film. In addition, such a conjugated polymer organic compound has a superior formability; thus, such a conjugated polymer organic compound contacts the ITO electrode highly closely. Furthermore, a precursor of such a compound forms a durable conjugated polymer layer after hardened. Therefore, it is possible to adjust a viscosity of a solution in which the precursor is solved at any desirable viscosity before heating and hardening such that the solution in which the precursor is solved can be used for an ink jet patterning operation which is explained later. Also, it is possible to form a layer under optimal condition easily and in a shorter time.

For such a precursor, for example, a precursor of PPV (poly (p-phenylenevinylene)) or its derivative is preferable. A precursor of PPV or its derivative is soluble in a water or an organic solution. Also, the precursor of PPV or its derivative can be formed in a polymer manner; therefore, it is possible to realize a high quality thin film from an optical point of view. Furthermore, PPV emits an intense illumination, and the PPV is a conductive polymer moieties which are non-localized on a polymer chain; therefore, it is possible to realize a high quality organic EL element.

For such a PPV or a precursor of PPV derivative, it is possible to name, for example, a precursor of PPV (poly(p-phenylenevinylene)), a precursor of MO-PPV (poly(2,5-dimethoxy-1,4-phenylvinylene)), a precursor of CN-PPV (poly(2,5-bishexyloxy-1,4-phenylene-(1-cyanovinylene))), precursor of MEH-PPV (poly[2-methoxy-5-(2'-ethylhexyloxy)]-p-phenylenevinylene).

Such a PPV or a precursor of PPV derivative are soluble in a water as explained above; thus, the a PPV or the precursor of PPV derivative can be in a polymer form by heating it after the formation of the layer so as to form a PPV layer. It is preferable that a content of the precursor such as the above PPV precursor is 0.01 to 10.0 wt % in a total composition. It is more preferable that a content of the precursor such as the above PPV precursor is 0.1 to 5.0 wt % in a total composition. If an amount of doped precursor is too small, it is not sufficient to form a conjugated polymer layer. If an amount of doped precursor is too much, there is a possibility that the viscosity in the compound becomes too high; thus, such a compound cannot be preferably used for a patterning operation in an ink jet method.

Furthermore, it is preferable that a member for forming the illuminating layer should contain at least a fluorescent color element. By doing this, it is possible to change the illuminating characteristics in the illuminating layer. For example, such a feature is effective for improving the illumination efficiency in the illuminating layer and changing light absorption maximum wavelength (illuminating color). That is, it is possible to use the illuminating color element not only for a member for forming an illuminating layer, but also for a color element member which illuminates by itself For example, it is possible to transmit approximately entire energy in an exciton which is generated in re-combination of carriers on molecules of a conjugated organic compound to the illuminating color element molecule. In such a case, illumination occurs in the illuminating color element molecules having higher illuminating quantum efficiency first than in the illuminating color element molecules having lower illuminating quantum efficiency. Therefore, an electricity quantum efficiency in the illuminating layer increases accordingly. Therefore, by adding the illuminating color element in a member for forming the illuminating layer, an illumination spectrum in the illuminating layer becomes equivalent to an illumination spectrum which is observed in an illuminating molecule; thus, it is effective for a method for changing the illuminating color.

Here, an electricity quantum efficiency is defined as a scale for evaluating an illumination according to a function for illumination. The electricity quantum efficiency is defined by a formula as follows.

$$\eta E = \text{energy in an emitted photon/inputted electric energy}$$

Consequently, by converting the light absorption maximum wavelength by doping the illuminating color element, it is possible to illuminate three primary colors such as red, blue, and green. As a result, it is possible to realize a full-color display member.

Furthermore, it is possible to improve the illumination efficiency in the EL element greatly by doping the illuminating color element.

For such an illuminating color element, it is preferable to use a Rhodamine having a red illuminating color, or a Rhodamine derivative when an illuminating layer for a red illuminating color is formed. These illuminating color element is a low-molecular-weight color element; therefore, these illuminating color elements are soluble in an aqueous solution. Also, these illuminating color elements have better compatibility with the PPV; thus, it is possible to form a uniform stable illuminating layer easily. Specifically, for such an illuminating color element, it is possible to name Rhodamine B, Rhodamine B base, Rhodamine 6G, Rhodamine 101 perchlorate, and the like. Also, it is possible to use a mixture of at least two of the above color elements.

Also, it is preferable to use quinacridone and its derivative which illuminates in green color when an illuminating layer which illuminates in a green color is formed. These illuminating color element is a low-molecular-weight color element as similar to a case of the above red color illuminating color element; therefore, these illuminating color elements are soluble in an aqueous solution. Also, these illuminating color elements have better compatibility with the PPV; thus, it is possible to form an illuminating layer easily.

Furthermore, it is preferable to use distyrylbiphenyl and its derivative which illuminates in blue color when an illuminating layer which illuminates in a blue color is formed. These illuminating color element is a low-molecular-weight color element as similar to a case of the above red color illuminating color element; therefore, these illuminating color elements are soluble in an aqueous solution. Also, these illuminating color elements have better compatibility with the PPV; thus, it is possible to form an illuminating layer easily.

Also, for other illuminating color element which illuminates in blue color, it is possible to name a coumarin and its derivative. These illuminating color element is a low-molecular-weight color element as similar to a case of the above red color illuminating color element; therefore, these illuminating color elements are soluble in an aqueous solution. Also, these illuminating color elements have better compatibility with the PPV; thus, it is possible to form an illuminating layer easily. Specifically, for such an illuminating color element, it is possible to name coumarin, coumarin-1, coumarin-6, coumarin-7, coumarin 120, coumarin 138, coumarin 152, coumarin 153, coumarin 311, coumarin 314, coumarin 334, coumarin 337, and coumarin 343.

Also, for other illuminating color element which illuminates in blue color, it is possible to name a tetraphenylbutadiene (TPB) or a TPB derivative. These illuminating color element is a low-molecular-weight color element as similar to a case of the above red color illuminating color element; therefore, these illuminating color elements are soluble in an aqueous solution. Also, these illuminating color elements have better compatibility with the PPV; thus, it is possible to form an illuminating layer easily.

Regarding the above illuminating color elements, it is possible to use one illuminating color element for each color. Also, it is possible to use two of the above illuminating color elements in a mixture form.

It is preferable that 0.5 to 10 wt % of illuminating color element is doped to a solid compound of the precursor in the conjugated polymer organic compound. It is more preferable that 1.0 to 5.0 wt % of illuminating color element is doped to a solid compound of the precursor in the conjugated polymer organic compound. When too much amount of the illuminating color element is doped, it is difficult to maintain a durability and a weatherability in the illuminating layer. On the other hand, when the amount of the illuminating color element which is doped is too low, it is not possible to realize an effect by the above operation in which more illuminating color element is added.

Also, it is preferable that the above precursor and the illuminating color element are dissolved or dispersed in a polar solvent so as to be an ink, and the ink is ejected from the liquid drop ejecting head 4. The polar solvent can dissolve easily or disperse uniformly the precursor and the illuminating color element; therefore, it is possible to prevent the solid compound of a member for forming the illuminating layer from adhering or clogging in a nozzle hole in the liquid drop ejecting head 4.

For such a polar solvent, it is possible to name an organic solvent or an inorganic solvent such a water, alcohol which is compatible with a water such as methanol or ethanol, N,N-dimethylformamide (DMF), N-methylpyrrolidone (NMP), Dimethylimidazoline (DMI), or Dimethylsulfoxide (DMSO). It is possible to use two or more of the above solvents preferably in a mixture form.

Furthermore, it is preferable that a wetting agent is added to a member for forming the illuminating layer. By doing this, it is possible to prevent the member for forming the illuminating layer from desiccating or coagulating in a nozzle hole in the liquid drop ejecting head 4 effectively. For such a wetting agent, it is possible to name polyhydric alcohol such as glycerin or diethylene glycol. Also, it is possible to use two or more of the above wetting agents preferably in a mixture form. It is preferable that such a wetting agent is added in 5 to 20 wt % of a total amount of a member for forming the illuminating layer.

Here, it is acceptable that other dopant and a coating stabilizing member are added. For example, it is possible to use a stabilizer, a viscosity regulator, an age resistor, a pH regulator, an antioxidant, a resin emulsion, and a leveling agent.

By ejecting such a member 114A for forming a illuminating layer from a nozzle hole in the liquid drop ejecting head 4, the member 114A is applied on a positive hole injection layer 140A in the partition wall 150.

Here, an illuminating layer is formed by ejecting a member 114A for forming the illuminating layer. More specifically, a member for forming an illuminating layer in a red color, a member for forming an illuminating layer in a green color, and a member for forming an illuminating layer in a blue color are ejected and applied to a corresponding pixel 71. Here, the pixel 71 which corresponds to each color is disposed according to a predetermined regularity.

Figure 12B:
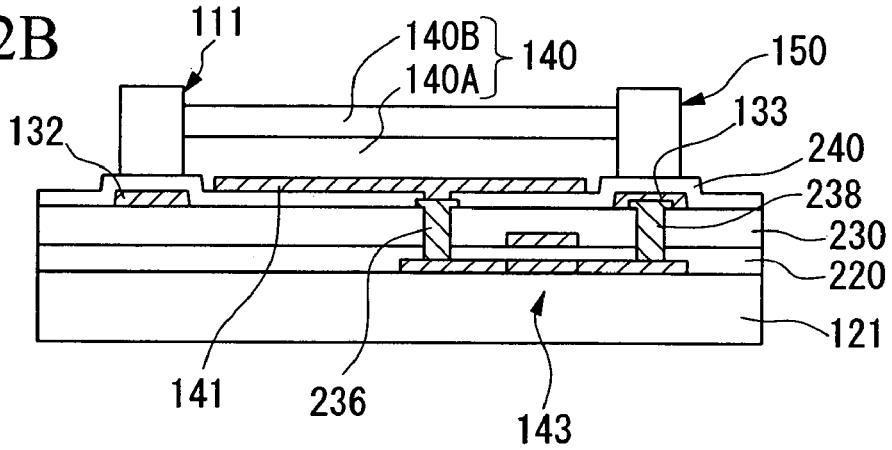

A member for forming an illuminating layer of each color is ejected and applied in this way, a solvent which is contained in the member 114B for forming the illuminating layer is evaporated; thus, a solid illuminating layer 140B is formed on a positive hole injection layer 140A as shown in FIG. 12B. By doing this, an illuminating section 140 which is formed by the positive hole injection layer 140A and the illuminating layer 140B can be obtained. Here, the evaporation of the solvent which is contained in the member 114B for forming the illuminating layer is performed by performing a heating operation or a decompressing operation according to necessity. A member for forming an illuminating layer is a quick-drying member because it usually dries preferably. Therefore, it is not necessary to perform such operations; therefore, it is possible to form illuminating layer 140B for each color in such a color-applying order by ejecting and applying a member for forming the illuminating layers sequentially.

Figure 12C:
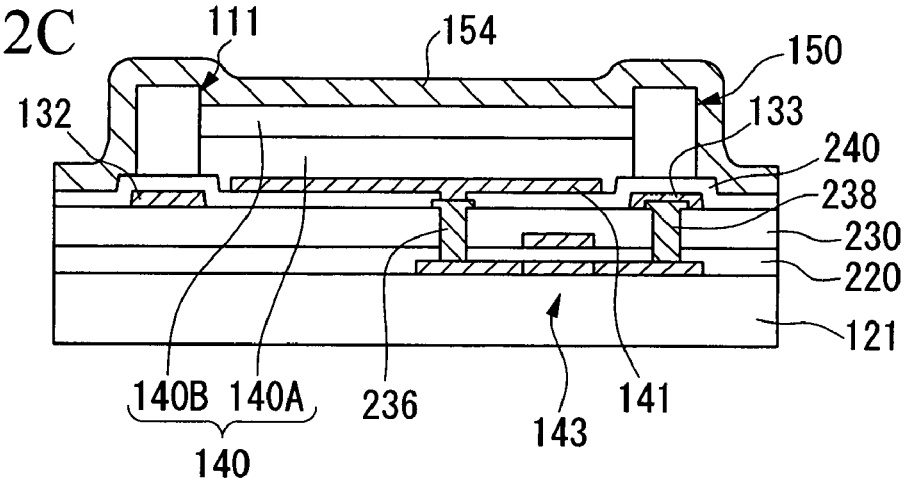

After that, a reflection electrode 154 is formed on an entire surface of the transparent base board 121 or in a stripe manner as shown in FIG. 12C; thus, an organic EL element is obtained.

According to such a method for manufacturing an organic EL element, a thin film such as a positive hole injection layer 140A and an illuminating layer 140B which form a part of an organic EL element is manufactured by a device 1 for forming a film; therefore, it is possible to control a thickness, a flatness, and a disposition of the positive hole injection layer 140A and the illuminating layer 140B highly precisely. Thus, it is possible to reduce a possibility of defect products and form an organic EL element stably and relatively cheaply.

(Electronic Apparatus)

Examples for a electronic apparatus which is provided with an optical element device (color filter or organic EL element) according to the above embodiments are explained with reference to drawings.

Figure 13:
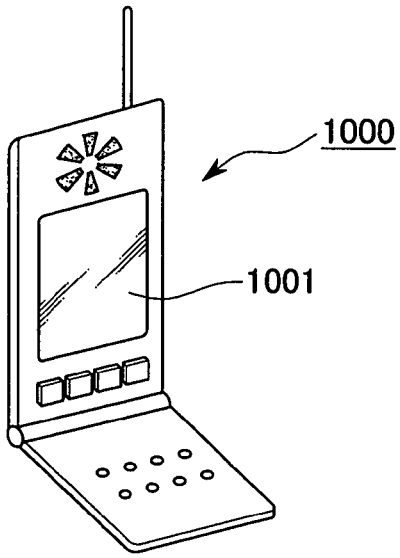
FIG. 13 shows an example for an electronic apparatus which is provided with an optical element according to the embodiments in the present invention.

FIG. 13 is a perspective view for an example of a mobile phone. In FIG. 13, reference numeral 1000 indicates a mobile phone unit. Reference numeral 1001 indicates a display section which uses the above optical element.

Figure 14:
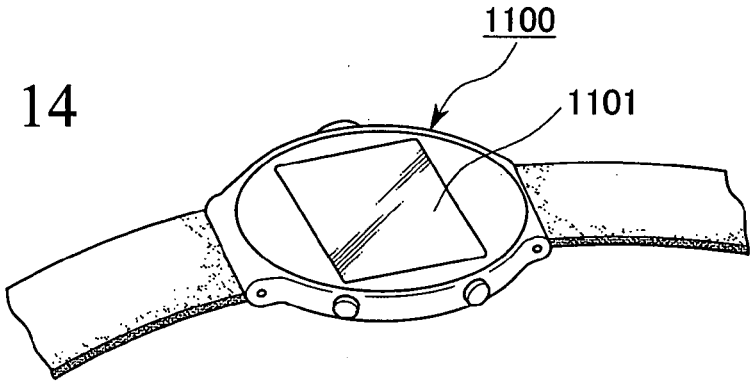
FIG. 14 shows an example for an electronic apparatus which is provided with an optical element according to the embodiments in the present invention.

FIG. 14 is a perspective view for an example of a watch electronic apparatus. In FIG. 14, reference numeral 1100 indicates a watch. Reference numeral 1101 indicates a display section which uses the above color filter.

Figure 15:
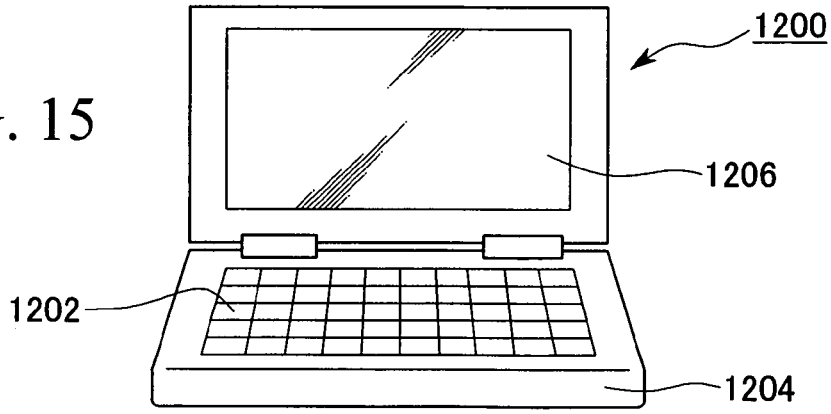
FIG. 15 shows an example for an electronic apparatus which is provided with an optical element according to the embodiments in the present invention.

FIG. 15 is a perspective view for an example of a mobile information processing device such as a word processor and a personal computer. In FIG. 15, reference numeral 1200 indicates an information processing device. Reference numeral 1202 indicates an input section such as a keyboard. Reference numeral 1204 indicates an information processing device unit. Reference numeral 1206 indicates a display section which uses the above color filter.

The electronic apparatuses shown in FIGS. 13 to 15 are provided with the optical elements according to the above embodiments; therefore, it is possible to display an image desirably. Also, it is possible to reduce a production cost and shorten a production period.

Here, the present invention is not limited to the above embodiments. The present invention can be used for manufacturing other devices. Various modifications can be made also with in a scope of essential features of the present invention. For example, it is possible to form a film which forms a metal wiring by ejecting a liquid member which contains a metal particle on a required surface from a device for driving a liquid drop ejecting head according to the above embodiments. By doing this, it is possible to form a film which forms a metal wiring stably for a longer time; therefore, it is possible to produce a metal wiring which is made from a thin film of which thickness, flatness, disposition are controlled more precisely than a conventional case, such as a metal wiring in which disconnection ratio is low and highly dense disposition is possible cheaply.

What is claimed is:

1. A device which is provided with a piezoelectric transducer for driving a liquid drop ejecting head for ejecting a functional liquid by using the piezoelectric transducer comprising:

a memory with corresponding address spaces;

a controlling section for memorizing an information which relates to an inclination value of a plurality of different line-segmented-waveforms in the memory, reading out the information which relates to the inclination value of line-segmented-waveform from the corresponding memory according to a predetermined readout timing, forming the line-segmented-waveform according to the information which relates to the inclination value, and generating a driving waveform by combining the line-segmented-waveforms; and a driving section for driving the piezoelectric transducer by the driving waveform and ejecting a liquid drop from an ejecting section on the liquid drop ejecting head, wherein the information which relates to the inclination value contains information for a variation amount of voltage of the line-segmented-waveform per a unit interval, a plurality of different information for the variation amount of voltage correspond to the line-segmented-waveform, and a plurality of the different information for the variation amount of voltage are stored in the memory.

2. A driving device for a liquid drop ejecting head according to claim 1 wherein the line-segmented-waveform is formed by waveforms of which variation amount of voltage becomes smaller nearer an end section of the driving waveform.

3. A driving device for a liquid drop ejecting head according to claim 1 wherein the driving waveform contains an ejection waveform for ejecting the liquid drop and a micro-vibration waveform for causing a micro-vibration on the piezoelectric transducer such that the liquid drop is not ejected.

4. A device for forming a membrane comprising a driving device for the liquid drop ejecting head according to claim 1 for forming a membrane on an object by ejecting a functional liquid from the liquid drop ejecting head.

5. A device for forming a membrane according to claim 4 wherein the device for forming a membrane manufactures a color filter.

6. A device for forming a membrane according to claim 4 wherein the device for forming a membrane manufactures a membrane which becomes a part of an organic electro-luminescent element.

7. A device which is provided with a piezoelectric transducer for driving a liquid drop ejecting head for ejecting a functional liquid by using the piezoelectric transducer comprising:

an output section which outputs information which relates to a plurality of different inclination values of a line-segmented-waveform;

a controlling section for forming the line-segmented-waveform according to the information which relates to the inclination value which is outputted from the output section and generating a driving waveform by combining line-segmented-waveforms; and a driving section for driving the piezoelectric transducer by the driving waveform and ejecting a liquid drop from an ejecting section on the liquid drop ejecting head, wherein the output section outputs information which relates to the inclination value which contains information for the variation amount of voltage of the line-segmented-waveform per a unit interval such that a plurality of different information for the variation amount of voltage correspond to the line-segmented-waveform.

8. A method for driving a liquid drop ejecting head for ejecting a functional liquid comprising steps of:

storing information which relates to an inclination value of a plurality of different line-segmented-waveforms in a memory with corresponding address spaces;

reading out the information of the inclination value of the line-segmented-waveform from the corresponding memory address space according to a predetermined readout timing when the address space is designated;

forming a line-segmented-waveform according to the information which relates to the inclination value;

generating a driving waveform by combining line-segmented-waveforms; and driving a piezoelectric transducer by the driving waveform and ejecting the liquid drop from a ejecting section, wherein the information which relates to the inclination value contains information for a variation amount of voltage of the line-segmented-waveform per a unit interval, a plurality of different information for the variation amount of voltage correspond the line-segmented-waveform, and a plurality of the different information for the variation amount of voltage are stored in each memory.

9. A method for driving a liquid drop ejecting head according to claim 8 wherein the line-segmented-waveform is formed by waveforms of which variation amount of voltage becomes smaller nearer an end section of the line-segmented-waveform.

10. A method for manufacturing a device by forming a functional liquid on a predetermined position of a base board by using a method for driving a liquid drop ejecting head according to claim 9.

11. A method for driving a liquid drop ejecting head according to claim 8 wherein the driving waveform contains an ejection waveform for ejecting the liquid drop and a micro-vibration waveform for causing a micro-vibration on the piezoelectric transducer such that the liquid drop is not ejected.

12. A method for manufacturing a device by forming a functional liquid on a predetermined position of a base board by using a method for driving a liquid drop ejecting head according to claim 11.

13. A method for forming a membrane by using a method for driving a liquid drop ejecting head according to claim 8.

14. A method for forming a membrane according to claim 13 wherein which is used for manufacturing a membrane which becomes a part of a color filter.

15. A method for forming a membrane according to claim 13 which is used for forming a membrane which becomes a part of an organic electro-luminescent element.

16. A method for forming a membrane according to claim 13 which is used for forming a membrane which becomes a part of an electronic apparatus.

17. A method for manufacturing a device by forming a functional liquid on a predetermined position of a base board by using a method for driving a liquid drop ejecting head according to claim 8.

18. A method for driving a liquid drop ejecting head for ejecting a functional liquid comprising the steps of:

outputting from an output section an information of a plurality of different inclination values of a line-segmented-waveform;

forming the line-segmented-waveform according to the information of the inclination values which are outputted from the output section;

generating a driving waveform by combining line-segmented-waveforms;

driving a piezoelectric transducer by the driving waveform; and ejecting a liquid drop from the ejecting section on the liquid drop ejecting head, wherein the information which relates to the inclination value contains information for a variation amount of voltage of the line-segmented-waveform per a unit interval, and a plurality of different information for the variation amount of voltage correspond the line-segmented-waveform.

19. A method for manufacturing a device by forming a functional liquid on a predetermined position of a base board by using a method for driving a liquid drop ejecting head according to claim 18.

* * * * *